US012679505B2

(12) United States Patent
Renaud et al.

(10) Patent No.: US 12,679,505 B2
(45) Date of Patent: Jul. 14, 2026

(54) ENCLOSURE SYSTEM FOR A PONTOON BOAT

(71) Applicant: Polaris Industries Inc., Medina, MN (US)

(72) Inventors: Benoit J. Renaud, Elkhart, IN (US); Brian M. Rupp, Goshen, IN (US); Walter B. Ross, Middlebury, IN (US); Richard Smith, Medina, MN (US)

(73) Assignee: POLARIS INDUSTRIES INC., Medina, MN (US)

( * ) Notice: Subject to any disclaimer, the term of this patent is extended or adjusted under 35 U.S.C. 154(b) by 577 days.

(21) Appl. No.: 18/121,915

(22) Filed: Mar. 15, 2023

(65) Prior Publication Data

US 2023/0211853 A1 Jul. 6, 2023

Related U.S. Application Data

(63) Continuation-in-part of application No. 17/475,621, filed on Sep. 15, 2021, now Pat. No. 11,858,592.

(Continued)

(51) Int. Cl.
*B63B 17/04* (2006.01)
*B63B 1/12* (2006.01)

(Continued)

(52) U.S. Cl.
CPC ..... *B63B 17/04* (2013.01); *B63B 1/121* (2013.01); *B63B 29/06* (2013.01); *B63B 2001/123* (2013.01); *B63B 2029/043* (2013.01)

(58) Field of Classification Search
CPC ..... B63B 17/00; B63B 17/0045; B63B 17/02; B63B 17/04; B63B 1/00; B63B 1/02;

(Continued)

(56) References Cited

U.S. PATENT DOCUMENTS 4,040,134 A * 8/1977 Downing ..... B63C 13/00 114/61.1
4,829,926 A * 5/1989 Voelkel ..... B63B 7/02 114/352

(Continued)

FOREIGN PATENT DOCUMENTS

CA 3130984 3/2022

OTHER PUBLICATIONS

"U.S. Appl. No. 17/475,621, 312 Amendment filed Nov. 7, 2023", 8 pgs.

(Continued)

*Primary Examiner* — Daniel V Venne
(74) *Attorney, Agent, or Firm* — SCHWEGMAN LUNDBERG & WOESSNER, P.A.

(57) ABSTRACT

A pontoon boat with a fencing defining the passenger region on a deck of the pontoon boat. The fencing comprising a plurality of fencing sections, each fencing section comprising a fencing framework and paneling secured to the fencing framework. The system may include detachable rail caps and/or rail attachments that hold the skin against the rail. The fencing framework of each fencing section may comprise a plurality of aluminum tubular extrusion segments with opposing open ends, a plurality of segment connectors interconnecting the tubular extrusion segments, each segment connector having a main body portion and a plurality of insert portions extending from and unitary with the respective main body portion, the plurality of tubular extrusion segments including a plurality of panel holding tubular extrusion segments, each with edge panel retainer strips attached thereto that secure an edge portion of the paneling to the respective tubular extrusion segment.

15 Claims, 30 Drawing Sheets

Related U.S. Application Data

(60) Provisional application No. 63/079,756, filed on Sep. 17, 2020.

(51) Int. Cl.
*B63B 29/04* (2006.01)
*B63B 29/06* (2006.01)

(58) Field of Classification Search
CPC ... B63B 1/121; B63B 2001/123; B63B 29/00; B63B 29/02; B63B 2029/0043; B63B 29/06; F16M 13/022
USPC ..... 114/343, 364
See application file for complete search history.

(56) References Cited

U.S. PATENT DOCUMENTS

| | | | | |
|---|---|---|---|---|
| 5,911,187 | A * | 6/1999 | Sohm | B63B 1/12 114/283 |
| 6,067,925 | A * | 5/2000 | Little | B63B 7/02 114/354 |
| 6,588,361 | B2 | 7/2003 | Biedenweg | |
| 7,222,582 | B1 | 5/2007 | Whiting et al. | |
| 7,484,472 | B1 | 2/2009 | Highfield | |
| 7,950,340 | B1 | 5/2011 | Curtis | |
| 8,056,495 | B2 * | 11/2011 | Lemons | F16B 2/185 114/361 |
| 8,359,994 | B1 | 1/2013 | Highfield | |
| D764,380 | S | 8/2016 | Conrad | |
| 10,486,772 | B1 * | 11/2019 | Sohm | B63B 1/121 |
| 10,724,679 | B2 | 7/2020 | Parniske et al. | |
| 11,192,610 | B2 | 12/2021 | Fishburn et al. | |
| 11,312,450 | B1 | 4/2022 | Rose et al. | |
| 11,618,521 | B2 | 4/2023 | Meng | |
| 11,858,592 | B2 | 1/2024 | Renaud et al. | |
| 2007/0022938 | A1 | 2/2007 | Fishburn | |
| 2011/0164408 | A1 | 7/2011 | Bol | |
| 2022/0081070 | A1 | 3/2022 | Renaud et al. | |

OTHER PUBLICATIONS

"U.S. Appl. No. 17/475,621, Corrected Notice of Allowance mailed Nov. 22, 2023", 6 pgs.
"U.S. Appl. No. 17/475,621, Non Final Office Action mailed May 16, 2023", 7 pgs.
"U.S. Appl. No. 17/475,621, Notice of Allowance mailed Aug. 22, 2023", 9 pgs.
"U.S. Appl. No. 17/475,621, Response filed Aug. 16, 23 to Non Final Office Action mailed May 16, 2023", 14 pgs.

* cited by examiner

800

| | |
|---|---|
| STORING PONTOON SKIN IN ROLLS AT REPAIR FACILITY | 801 |
| STORING PONTOON SKIN IN ROLLS AT PONTOON BOAT MANUFACTURING FACILITY | 802 |
| CUTTING SKIN TO SKIN SECTIONS SIZED TO FIT FENCING SECTION | 803 |
| PAINTING SKIN ROLL BEFORE CUTTING | 804 |
| PAINTING SKIN AFTER CUTTING | 805 |
| STOCKPILING SEGMENT CONNECTORS AT REPAIR FACILITY | 806 |
| STOCKPILING SEGMENT CONNECTORS AT PONTOON BOAT MANUFACTURING FACILITY | 807 |
| INJECTION MOLDING SEGMENT CONNECTORS REMOTE FROM REPAIR FACILITY | 808 |
| INJECTION MOLDING SEGMENT CONNECTORS REMOTE FROM PONTOON BOAT MANUFACTURING FACILITY | 809 |
| SHIPPING REMOTELY MANUFACTURED SEGMENT CONNECTORS TO REPAIR FACILITY | 810 |
| SHIPPING REMOTELY MANUFACTURED SEGMENT CONNECTORS TO PONTOON BOAT MANUFACTURING FACILITY | 811 |
| SHIPPING SEGMENT CONNECTORS TO PONTOON BOAT OWNER | 812 |
| MANUFACTURING SEGMENT CONNECTORS AT REPAIR FACILITY | 813 |
| MANUFACTURING SEGMENT CONNECTORS AT PONTOON BOAT MANUFACTURING FACILITY | 814 |
| ASSEMBLING A FENCING SECTIONS FROM SEGMENTS AND CONNECTORS | 815 |
| BOAT OWNER ASSEMBLING FENCING SECTIONS FROM SEGMENTS AND SEGMENT CONNECTORS | 816 |
| BOAT OWNER ASSEMBLING FENCING SECTIONS FROM KIT | 817 |
| WELDING FENCING SECTIONS FROM SEGMENTS AT MANUFACTURING FACILITY | 818 |
| CUTTING EXTRUSION SEGMENTS TO SIZE AT A REPAIR FACILITY | 819 |
| CUTTING EXTRUSION SEGMENTS TO SIZE AT MANUFACTURING FACILITY | 820 |
| CUTTING EXTRUSION SEGMENTS TO SIZE BY PONTOON BOAT OWNER | 821 |
| ATTACHING SKIN TO FENCING SECTIONS UTILIZING UNITARY ELONGATE TABS ON EXTRUSIONS | 822 |
| ATTACHING SKIN SECTIONS TO FENCING SECTIONS UTILIZING RESILIENT POLYMER RAIL COUPLERS | 823 |
| SHIPPING UNASSEMBLED FENCING SECTIONS COMPRISING SEGMENTS, SEGMENT CONNECTORS AND PRECUT SKIN TO BOAT OWNER | 824 |
| SHIPPING UNASSEMBLED FENCING SECTIONS COMPRISING SEGMENTS, SEGMENT CONNECTORS AND PRECUT SKIN TO REPAIR FACILITY | 825 |
| SHIPPING KIT OF FENCING COMPONENTS TO BOAT OWNER | 826 |
| ASSEMBLING KIT OF FENCING SECTION AND SHIPPING TO REPAIR FACILITY | 827 |
| ASSEMBLING KIT OF FENCING SECTION AND SHIPPING TO BOAT OWNER | 828 |
| REMOVING A SKIN SECTION BY REMOVING A RESILIENT POLYMER COUPLER SEATED IN A SLOT IN A SEGMENT | 829 |
| REPLACING A SKIN SECTION BY REMOVING AND REPLACING A RESILIENT POLYMER RETAINER SEATED IN A SLOT IN A RAILING | 830 |
| SECURING A SKIN SECTION TO A FENCING FRAMEWORK BY UTILIZING A RESILIENT POLYMER RETAINER ATTACHED TO AN ALUMINUM EXTRUSION SEGMENT WHERE AN EDGE PORTION OF THE SKIN SECTION IS SANDWICHED BETWEEN RETAINER AND THE ALUMINUM EXTRUSION SEGMENT | 831 |
| SECURING A SKIN SECTION TO A FENCING FRAMEWORK UTILIZING DOUBLE SIDED TAPE OR AN ADHESIVE | 832 |
| REPLACING A SKIN SECTION OF A PONTOON BOAT FENCING BY DISASSEMBLING CONNECTIONS OF A FENCING SECTION COMPRISING ALUMINUM EXTRUSION SEGMENTS AND POLYMER SEGMENT COUPLERS | 833 |
| CONNECTING ALUMINUM EXTRUSION SEGMENTS TOGETHER IN A FENCING FRAMEWORK WITHOUT WELDING | 834 |
| CONNECTING ALUMINUM EXTRUSION SEGMENTS TOGETHER UTILIZING POLYMER SEGMENT CONNECTORS SEATED IN OPEN ENDS OF THE ALUMINUM EXTRUSION SEGMENTS | 835 |
| SECURING POLYMER SEGMENT CONNECTORS IN OPEN ENDS OF ALUMINUM SEGMENTS BY SECURING INSERT PORTIONS OF THE SEGMENT IN THE OPEN END AND USING ADHESIVES AND/OR THREADED FASTENERS EXTENDING THROUGH A WALL OF THE SEGMENT AND INTO THE INSERT PORTION OF THE CONNECTOR | 836 |
| SECURING SEGMENT CONNECTORS TO OPEN ENDS OF FENCING SEGMENTS UTILIZING AN INTERFERENCE FIT AND ADHESIVES AND/OR THREADED FASTENERS | 837 |

FIG. 57

ENCLOSURE SYSTEM FOR A PONTOON BOAT

RELATED APPLICATIONS

This application claims the benefit of and is a continuation in part of U.S. application Ser. No. 17/475,621 filed on Sep. 15, 2021, now U.S. Pat. No. 11,858,592, titled ENCLOSURE SYSTEM FOR A PONTOON BOAT which claims the benefit of U.S. Provisional Application No. 63/079,756, filed Sep. 17, 2020, titled ENCLOSURE SYSTEM FOR A PONTOON BOAT, the entire disclosures of each are expressly incorporated by reference herein.

FIELD

The present disclosure relates to systems and methods for above deck boat fencing or enclosure systems for a pontoon boat and, more particularly, to modular enclosure systems, frameworks and accompanying skin for a pontoon boat. Additionally, the disclosure relates to methods of assembly, replacement, and repair of such systems and components thereof.

BACKGROUND

Pontoon boats have gained tremendous popularity based on their smooth rides and capabilities of handle a high number of passenger comfortably. A great advantage of pontoon boats compared to conventional single hulled boats, is that they provide a wide range of options to be offered by the manufacturers in the passenger area such as varying seating arrangements.

Pontoon boats often have an enclosure system configured as fencing supported by the deck that serves as a boundary of a passenger compartment of the pontoon boat. Traditional enclosure systems include a welded aluminum skeletal system or framework that includes rails to which paneling or skins are attached by deforming a tab on the rails to crimp the skin to the rails. The skin can be slid along the rails before crimping, and crimping features on the rails are bent down to hold the skin against the rails. Adhesives, staples, or rivets are also often used to keep the skin in place in addition to or supplementing the rails.

Such repair, by replacing only the panels, whether it occurs during the buildout of the pontoon during manufacture, or if occurs in use by the end user, often or typically results in a non-satisfactory result. Therefore, typically when a section of fencing has a damaged panel, the entire section of fencing, including the framework and paneling is replaced. Such replacement of entire fencing sections is expensive due to high labor costs associated with, for example, welding of the tubular aluminum. Moreover, the old fencing section must be disposed of with the associated costs. Where the end user or a boat dealer needs a fencing section replaced remote from the place of fabrication, shipping costs are high since the entire fabricated fencing section must be shipped as the whole unit, and the unit, of course, must be carefully packed to prevent damage during such shipping. Additionally, such replacement typically requires the section be fabricated after the order, adding further delays.

A system and method for assembly of pontoon fencing that reduces labor costs to manufacture the fencing, that facilitates repair of damaged paneling of the fencing without replacing the entire fencing section, and that allows an end user to readily replace paneling, even for simple aesthetic purposes, would be well received by the pontoon manufacturing industry and the pontoon boating public.

SUMMARY

In embodiments, an enclosure system configured as fencing for a pontoon boat comprises a skeletal system configured as a fencing framework supporting a skin. The framework may be formed of welded rails or modular components having weldless connections between rails configured as tubular segments. The fencing framework comprising a plurality of rails including an upper rail having an open interior and a slot to the interior; a skin positioned against a first side of the upper rail; and a rail coupler configured as a resilient retainer strip extending along the upper rail, the rail coupler including a protrusion which is received in the slot of the upper rail into the interior of the upper rail to secure the rail coupler to the upper rail and further having an interface portion, the skin being captured between the interface portion of the rail coupler and the first side of the upper rail, the rail coupler coupling the skin to the fencing framework.

In an example thereof the rail coupler is removably coupled to the skeletal frame. In a further example thereof, the first wall is on the first side of the upper rail. In a still further example thereof, the first wall is on a second side of the upper rail. In yet a further example, the first side is vertically oriented and the second side is horizontally oriented. In still yet a further example thereof, the rail coupler is a rail cap which overlaps a plurality of exterior sides of the upper rail including the first side. In a variation thereof, the rail cap includes an attachment feature to receive an accessory to couple the accessory to the upper rail. In a further example thereof, the rail cap is made of a resilient material.

In embodiments, an enclosure system for a pontoon boat comprises a framework comprising a plurality of rails including an upper rail; a skin positioned against a first side of the upper rail; and a rail coupler extending along the first side of the upper rail, a second side of the upper rail opposite the first side, and a third side of the upper rail, the third side being between the first side and the second side, the skin being captured between an interface portion of the rail coupler and the first side of the upper rail, the rail coupler coupling the skin to the skeletal system.

In embodiments, the retainer strips are removably and resiliently coupled to the fencing framework. In another example thereof, the retainer strips each includes a first interactive member configured as an insertion portion which cooperates with a first external coupling feature, for example, a slot of the upper rail and a second interactive member which cooperates with a second external coupling feature of the upper rail. In a variation thereof, the first interactive member is a first protrusion and the and the second interactive member is a second protrusion, and the second external coupling feature of the upper rail is a second recess to receive the second protrusion. In still a further example thereof, the upper rail has a first width and the rail coupler includes a first leg and a second leg spaced apart from the first leg and a connecting portion, the first leg, the second leg, and the connecting portion defining a void wherein the upper rail is positioned, the first leg and the second leg having a separation prior to receiving the upper rail, the separation of the first leg and the second leg being less than the first width of the upper rail. In embodiments, the rail coupler is made of a flexible and resilient material. In embodiments, the rail coupler has a C-shaped portion, when viewed from the end of the coupler, for engaging and clamping about three sides of the rails. The C-shaped portion having an opening for receiving a rail, the opening having a width that is less when not on the rail compared to when placed on the rail. The resiliency of the material providing the clamping of the coupler to the rail and in embodiments provides clamping of the skin to the rail.

In embodiments, a method for adding a skin onto a pontoon boat comprises the steps of providing a skeletal frame including an upper rail supported by a deck of the pontoon boat; placing the skin against an outer surface of the upper rail; and attaching a rail cap onto the rail such that the rail cap presses the skin against the rail, thereby securing the skin to the upper rail.

In yet embodiments, a method for replacing a skin on a pontoon boat comprises the steps of moving a rail cap relative to an upper rail of a skeletal frame of the pontoon boat from a first position to a second position, wherein in the first position the rail cap holds the skin relative to the upper rail of the skeletal frame; removing the skin from a position against the upper rail; positioning a new skin along the upper rail; and moving the rail cap back to the first position to hold the new skin relative to the upper rail of the skeletal frame. In an example thereof, the second position is completely spaced apart from the upper rail of the skeletal frame.

In still yet embodiments, a method for replacing a skin on a pontoon boat comprises the steps of removing a rail cap relative to an upper rail of a skeletal frame of the pontoon boat from a first position to a second position, wherein in the first position the rail cap holds the skin relative to the upper rail of the skeletal frame; removing the skin from a position against the upper rail; positioning a new skin along the upper rail of the skeletal frame; and positioning a new rail cap relative to the upper rail to hold the skin relative to the upper rail of the skeletal frame.

In yet embodiments, an enclosure system for a pontoon boat comprises: a frame coupled to a deck of the pontoon boat comprising a number of rails; an illumination source coupled to at least one of the number of rails; and a rail coupler coupled to the at least one of the number of rails and extending over the illumination source, the rail coupler comprising a transparent portion configured to allow a light from the illumination source to pass through the rail coupler. In an example thereof, the enclosure system further comprises a skin positioned at least partially between the rail coupler and the at least one of the number of rails.

In embodiments, a pontoon boat with a fencing defining the passenger region on a deck of the pontoon boat. The fencing comprising a plurality of fencing sections, each fencing section comprising a fencing framework and paneling secured to the fencing framework. The fencing framework of each fencing section comprises modular components including a plurality of rails configured as aluminum tubular extrusion segments with opposing open ends, a plurality of segment connectors interconnecting the tubular extrusion segments, each segment connector having a main body portion and a plurality of insert portions extending into the open ends of the tubular extrusion segments. In embodiments, the plurality of tubular extrusion segments including a plurality of panel holding tubular extrusion segments, each with a skin retainer configured as a resilient retainer strips attached thereto that captures and secures an edge portion of the paneling to the respective tubular extrusion segment.

A pontoon boat, in embodiments, has fencing utilizing modular components for the fencing framework and further utilizes retainer strips, attachable and detachable from the framework, for securing the paneling, also known as the skin, onto the fencing framework. A feature and advantage is that damaged component in a fencing section may be readily replaced, without discarding the entirety of the fencing section. For example, pontoon boat with a damaged skin, the assembled fencing section, including the framework of the section, may be partially disassembled allowing the damaged panel to be removed, a new replacement panel installed in its place, with the framework reassembled. In embodiments the resilient retainer strips may be replaced when a new section of paneling is installed.

In embodiments, a limited number of configurations of tubular extrusions, cut into extrusion segments, may be combined with a limited number of connector components, to assemble the fencing framework, the connector components conforming to open ends of the extrusion segments. Separate retainer strips capture the edges of the paneling and secure the edges to the framework segments. In embodiments, the retainer strips have a tapered insertion portion, such as a prong, that is received into lengthwise grooves formed in the framework segments with the paneling edges sandwiched and secured between the retainer strip and an exterior surface of the framework segment to which the retainer strip is attached. The tapered end allows insertion of the insertion portion and an expanded portion with deflectable tabs locks the insertion portion into the framework segment groove.

In embodiments, a modular system for erecting fencing for pontoon boat decks comprises a plurality of aluminum extruded framework segments, a plurality of segment connectors for connecting the framework segments at their end portions to form the fencing framework with fencing framework windows, sheet metal paneling configured as a plurality of panels, the panels sized to the fencing framework windows, and a plurality of resilient paneling retainer strips securable to the framework segments to secure edge portions of the plurality of panels to the fencing framework thereby securing the panels in the fencing framework windows.

In embodiments, each framework segment may be cut from an aluminum extrusion, each framework segment having end portions with end openings and an elongate groove extending the length of the segment. In embodiments, the plurality of segment connectors for connecting framework segments at their end portions each have an exposed portion and a plurality of insert portions for insertion into the end opening of the framework segments. The insert portions conformingly shaped to be snugly received in the end portion end openings of the framework segments.

A feature and advantage of embodiments is that a robust, structurally strong fencing framework may be assembled utilizing modular components. This allows manufacture and fabrication of the principal components of the fencing remote from the place of assembly of the fencing on the pontoon boat. In embodiments, all of the fabrication of the components of a pontoon boat fencing, except the fabrication of particular sheet aluminum panels may be done remotely from the place of fabrication of the fencing and/or pontoon boat. A feature and advantage of embodiments, is that segment connectors can be advantageously outsourced providing optimized pricing, and may be readily warehoused, using relatively little space, at, for example, the pontoon boat manufacturing facility. A feature and advantage of embodiments, is that a boat owner may be able to replace panels of the fencing of their pontoon boat easily and without specialized tools and without specialized training, providing a like-new quality and appearance.

A feature and advantage of embodiments is that principal components of the fencing for pontoon decks is formed from conventional materials readily available to manufacturers, for example, aluminum extrusions for the framework segments, sheet aluminum of 0.032 or 0.050 inch thickness for the paneling, and conventional metal connectors such as screws and rivets. Additionally, the pontoon deck fencing comprises fencing segment connectors formed of conventional materials such as polymers, for example as polyvinyl chloride (PVC) formulations, or aluminum or other metal castings or machined parts. The segment connectors may be configured, for example as, in-line connectors to coaxially connect two segments, or configured as an L-connector to connect two segments defining an L shape which may be perpendicular or obliquely arranged with respect to each other, or configured as T-connectors to connect two segments coaxially and a third segment perpendicular or obliquely to the two coaxial segments, or configured as a Y-connector for connecting three segments, none of which are coaxial. Additional connector arrangements are contemplated in addition to these specific configurations.

A feature and advantage of embodiments is a method of assembly of a pontoon boat fencing framework that does not require welding, or as much welding, as in conventional fencing for pontoon boats. A further feature and advantage of embodiments, is a method of assembly of a pontoon boat fencing framework that can utilize lengths of extrusions and simply cut the lengths of extrusions to a needed length thereby providing the tubing segment with open ends. A repair facility (or the manufacturing facility) can maintain in stock inventory of different tubing extrusions, different segment connectors, rolls of aluminum sheet metal stock. To repair a fencing section, or to manufacture a new fencing section, the facility cuts to size the needed tubing segments, selects the particular needed segment connectors, cuts the needed paneling from the aluminum sheet metal stock, and assembles or repairs the fencing section. In embodiments, the facility may paint the aluminum or the rolls of sheet metal stock may be prepainted.

A feature and advantage of embodiments, is repairing fencing with a damaged panel does not require replacing the framework supporting the damaged panel, rather the panel itself may be replaced by partially disassembling the fencing framework, removing the damaged panel from the partially disassembled framework, replacing the damaged panel with a panel cut to the size of the replaced panel, installing and reassembling the fencing framework. In embodiments, the partial disassembly of the framework may involve removal of one, two, or all of the particular retainer strips securing the damaged panel from the fencing framework. The resilient polymer retainer strips may be reused or may be replaced as a consumable item when a panel is replaced.

A feature and advantage of embodiments is that there is no uncrimping and recrimping of metal hold-down tabs on fencing framework when fencing panels are replaced.

In embodiments of the invention, a fencing section framework may comprise aluminum tubing segments that utilize the unitary elongate tabs that are crimped onto the edge portion of the paneling rather than utilizing the resilient retainer strip inserted into the tubing slot. Such segments with the unitary elongate tabs may be combined with the tubing segments with the slots that receive the retainer strips, or the framework may be entirely formed of the tubing segments with the crimpable unitary tabs. The segments removably connected by the segment connectors such that upon repair of a fencing skin, to the extent a crimpable tab is damaged on a particular tubing segment, the segment may be replaced rather than the entire welded framework. In embodiments, the framework may be formed of extruded aluminum tubing members welded together in a conventional fashion but the tubing having the slots for receiving the resilient retainer strips. Replacement or repair of a damaged paneling section may be accomplished with removal of the resilient retainer strips, removal of the damaged paneling section, installation of a new paneling section, and securing the new panel section with new or existing resilient retainer strips. In embodiments, other configurations of replaceable retainer strips may be utilized that attach to the respective tubing segments in other ways, for example attachment by conventional metal fasteners, or fasteners that maintain the insertion portion of the retainer strip expanded in the tubing segment until the fastener is removed. Additionally, in embodiments, fasteners, such as screws, may supplement the attachment of the retainer strips to the rails, for example by the fastener extending through the insertion portion of the retainer strip that is seated in the slot of the rail, thereby effectuating expansion of the insertion portion in the interior of the railing and locking the insertion portion into the slot until the fastener is removed.

BRIEF DESCRIPTION OF THE DRAWINGS

The above-mentioned and other features and advantages of this disclosure, and the manner of attaining them, will become more apparent and will be better understood by reference to the following description of exemplary embodiments taken in conjunction with the accompanying drawings, wherein:

FIG. 57 is a chart of method steps that may be selected and combined.

Corresponding reference characters indicate corresponding parts throughout the several views. The exemplifications set out herein illustrates an exemplary embodiments of the invention and such exemplification is not to be construed as limiting the scope of the invention in any manner.

DETAILED DESCRIPTIONS

Figure 1:
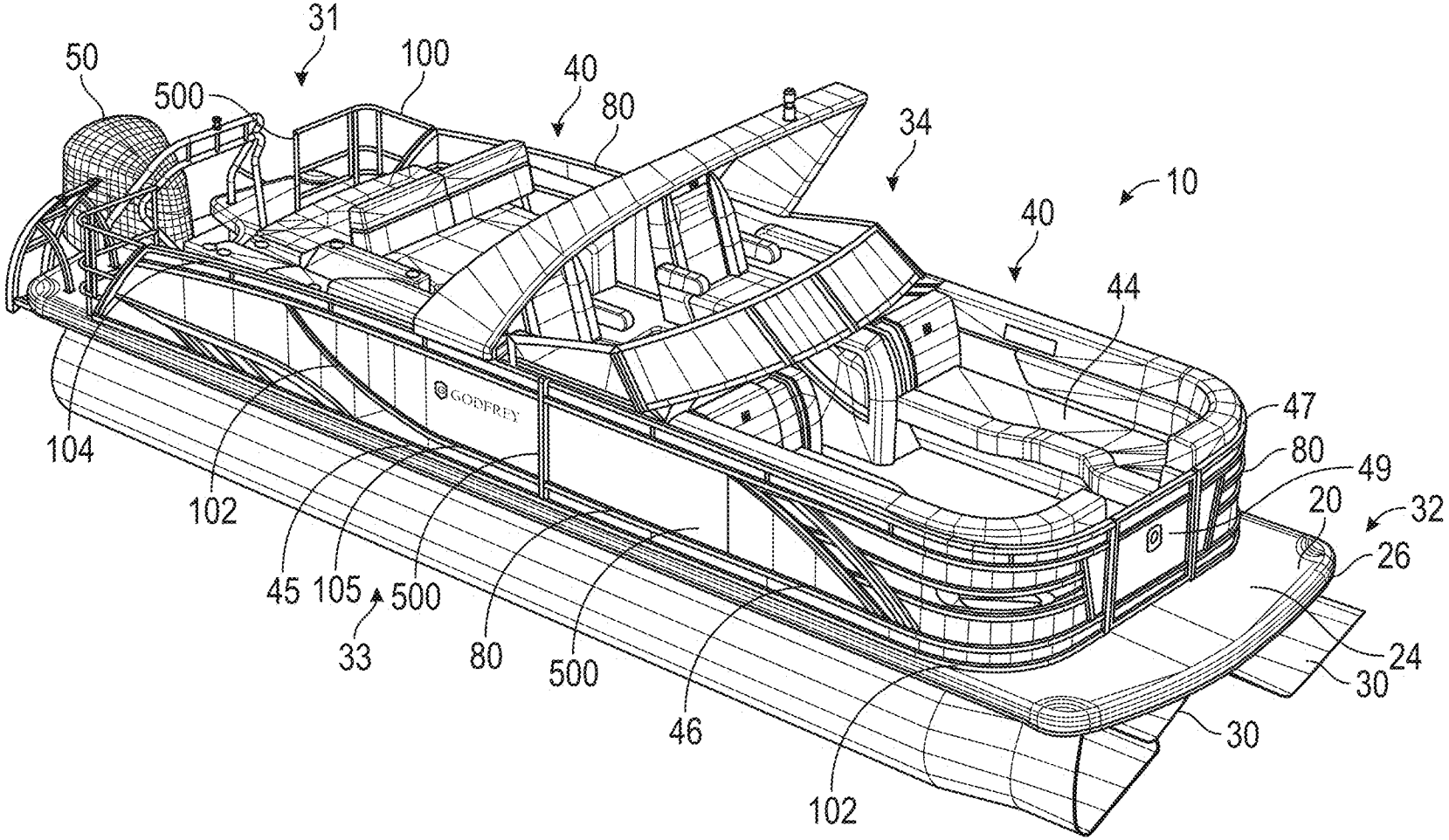
FIG. 1 illustrates a simplified pontoon boat with an exemplary enclosure system of the present disclosure.

For the purposes of promoting an understanding of the principles of the present disclosure, reference is now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couple," "attach," and "connect" and variations thereof are used to include both arrangements wherein the two or more components are in direct physical contact and arrangements wherein the two or more components are not in direct contact with each other (e.g., the components are "coupled" via at least a third component), but yet still cooperate or interact with each other.

In some instances throughout this disclosure and in the claims, numeric terminology, such as first, second, third, and fourth, is used in reference to various components or features. Such use is not intended to denote an ordering of the components or features. Rather, numeric terminology is used to assist the reader in identifying the component or features being referenced and should not be narrowly interpreted as providing a specific order of components or features.

Referring first to FIG. 1, a pontoon boat 10 is shown. Pontoon boat 10 comprises a driving system 50 (e.g. a motor), a number of pontoons 30, a deck 20 coupled to the pontoons 30, and an enclosure system 80, configured as fencing, coupled to the deck 20. The deck having an upper deck surface 24, and a deck periphery 26. The pontoon boat has a stern 31, a bow 32, a starboard side 33, and a port side 34. The enclosure system 80 generally defines an exterior and interior to the boat 10, wherein the enclosure system 80 encloses and defines a passenger area 40 on the boat 10. The passenger area may include pontoon boat furniture 44 such as seating, tables, driving mechanisms, flooring, storage space, or any other boat features as are known in the art. The fencing extends around the deck periphery 26 and includes a plurality of fencing sections 45, 46, 47, with a door 49 mounted between fencing sections.

Figure 3:
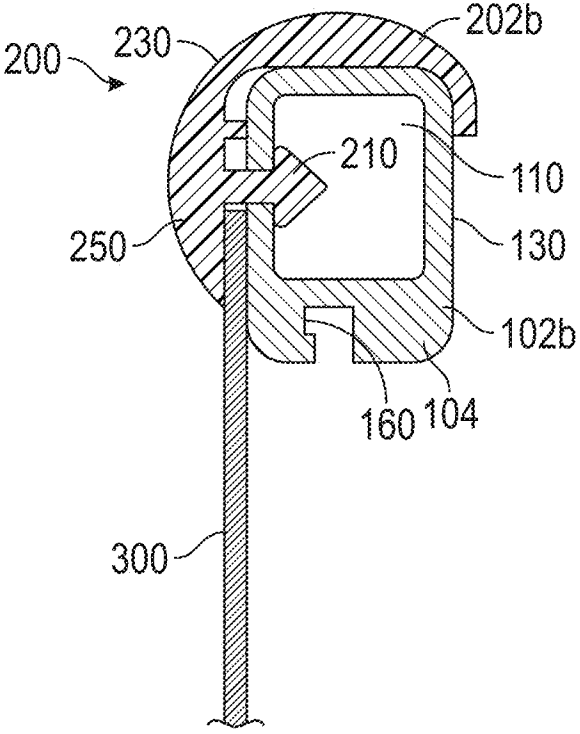
FIG. 3 illustrates a sectional view of another upper rail and associated rail cap.
Figure 2:
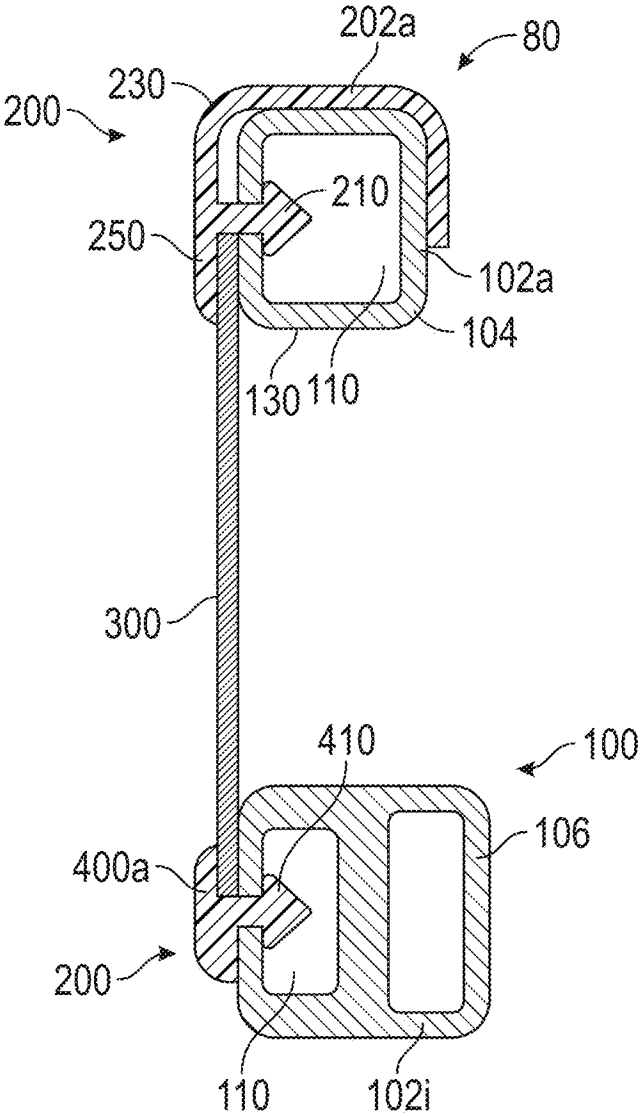
FIG. 2 illustrates a sectional view along L1 in FIG. 1 of an upper rail and lower rail of a skeletal frame of a pontoon boat having a skin spanning therebetween and secured with a plurality of rail couplers including a first rail cap and a first rail attachment.

Referring to FIGS. 1-3, the fencing or enclosure system 80 comprises a rail system 100, and a skin 300. The rail system 100 generally defines a frame or skeleton for the enclosure system 80 around the boat 10, and accordingly may also be referred to as a framework or skeletal system. In embodiments, the framework may be formed of welded aluminum tubing and/or may be formed of modular components with weldless connections between rail components. In embodiments, the enclosure system 80 and/or rail system 100 may only enclose a portion of the boat 10 and may also be positioned within the interior of the boat 10. For example, the bow and stern of the boat 10 may have fiberglass body panels while the port and starboard sides of the boat 10 may have the rail system. When positioned in the interior, the enclosure system 80 or rail system 100 may divide the boat into separate sections or provide additional partitions within boat 10. Rail system 100 is not limited to standard "rails" as is known in the art but may comprise any materials or structural elements to provide a framework to the enclosure system 80. The rail system 100 comprises a number of rails 102, a number of support rails 500, and a number of rail couplers 200 configures as paneling retainer strips. Rail couplers 200 may be rail caps 202, rail attachments 400, or any other features or devices that may couple to rail system 100. Rail couplers 200 may also be described as rail or exterior features, or rail or exterior connectors. Rails 102 form the framework of rail system 100 and provide a primary structure for enclosing the passenger area of the pontoon boat 10. Rails 102 may be an upper rail 104, a middle rail 105 (see FIG. 13), a lower rail 106, or a support rail 500. The support rails 500 or lower rails 102 provide structural support to rail system 100 and may couple components of rail system 100 to one another. Skin 300 extends generally between two rails 102 and forms a wall around or within the boat 10. In embodiments, the enclosure includes multiple skin pieces which collectively form a wall around or within the boat 10. As shown in FIG. 2, skin 300 may extend between an upper rail 104 and a lower rail 106. Rails 102 may comprise a single rail extending around the boat 10, or of multiple pieces coupled together through welds, adhesives, rivets, staples, or any other suitable coupling devices. As shown in FIG. 1, rails 102 are generally horizontal and run approximately parallel to the deck 20 of the boat 10, but in other embodiments rails 102 may extend in any direction and may be formed into any shape. For example, rails 102 may curve towards or away from the deck 20 to form a more stylized rail system 100. Rails 102 may made from metals, polymers, wood, composites, or any other material to provide desired structural properties for rail system 100. In embodiments, rails 102 are formed from aluminum extrusions cut to appropriate sizes and welded together to form sections of the enclosure.

In an exemplary embodiment, rails 102 are coupled to the boat 10 through support rails 500. In other embodiments, rails 102 may be coupled directly to boat 10 (for example, the lower rail 102 in FIG. 1). Support rails 500 provide structural support to rail system 100 and may couple any number of support rails 102 together. Support rails 500 may be coupled to rails 102, deck 20, skin 300, or other support rails 500 through welds, adhesives, friction, rivets, screws, staples or any other devices configured to couple with support rails 500. Rails 102 (including support rails 500) may also be coupled to deck 20 through deck fasteners 450 as described further below. Support rails 500 may be generally vertically oriented and may extend generally perpendicular to the deck 20 of boat 10, yet in other embodiments, support rails 500 may extend in any direction and have any shape. For example, support rails 500 may curve or bend throughout the rail system 100 and may be angled relative to deck 20. Support rails 500 may be altered in shape or orientation to provide additional support or add stylized features or designs to rail system 100.

In the illustrated embodiment, rails 102 comprise an exterior 130 and an interior 110. In other embodiments, rails 102 may be a solid piece without an open interior 110. Furthermore, the rails 102 as illustrated are generally rectangular in shape, but in other embodiments may have any shape cross-section. Rail exterior 130 may comprise texture or features such as grooves, bumps, ridges, or any other surface features. Such surface features on the rail exterior 130 may provide a surface that is more appealing for users to interact with, and may also provide additional grip or adhesion to other components of rail system 100. Furthermore, rail exterior 130 may be coated with various materials to provide additional adhesion, weather/damage resistance, or improved tactile features. Rails 102 may also comprise a number of coupling features 160 (See FIG. 3). Coupling features 160 may be used to couple a variety of attachments to rails 102, including canopies, canvases, colored accents, bumpers, rubber inserts, or other attachments as are known in the art. Further, as described herein, rails 102 may include one or more exterior pockets which receive accent pieces or accessories.

Referring to FIGS. 2-3 the rail couplers 200 of the rail system 100 include a number of rail caps 202, which may also be referred to simply as caps 202, and a number of rail attachments 400. In the illustrated embodiment, caps 202 comprise a cap exterior 230, interface portion 250, and at least one interactive member 210. Caps 202 are generally configured to extend around three sides of rails 102 and to couple to rails 102. In the illustrated embodiments, caps **202*a* couple to rails 102*a* through interactive member 210. Interactive member 210 may be any feature that allows caps 202 to be coupled to rails 102. As illustrated in exemplary caps 202*a*, 202*b*, and 202*c*, interactive member 210 may be a protrusion that extends from cap 202 into the interior 110 of rail 102. As shown, the protrusion has a flange-like portion that retains the interactive member 210 within interior 110. The interactive member 210 may be configured to be flexible or deformable such that the interactive member 210 may be pushed/squeezed into the interior 110 of rails 102 through an opening in rails 102, wherein the opening within rails 102 is generally smaller than the resting state of the interactive member 210. Accordingly, the interactive member 210 may expand to a resting state upon passing through the opening to secure the cap 202 to the rail 102. The interactive member 210 may be inserted into rails 102 through a hole, bore, or opening in the rail 102, or may be slid into interior 110 starting from an end of rail 102 and slid along the length of rail 102. Interactive members 210 may be continuous along the entire length of the cap 202, or may be discrete elements located at various points along the cap 202. Furthermore, interactive members 210 may interact with any side of the rail 102**, and may interact with more than one side in a given embodiment.

The interface portion 250 of cap 202 is configured to interface, couple, or otherwise engage with the skin 300 and to couple the skin 300 to rail 102 when the caps 202 are coupled to rails 102. Interface portion 250 may comprise surface features such as bumps, ridges, or other textures to provide additional grip to skin 300. In an exemplary embodiment, the interface portion 250 of cap 202 is pressed against the skin 300 by a force caused by the interactive member 210 being retained within rail 102. Furthermore in the exemplary embodiment, interactive members 210 do not extend through skin 300, and only the interface portion 250 of the caps 202 couple the skin 300 to the rails 102. This configuration allows for the skin 300 to be moved by simply removing the caps 202 from the rail system 100. In other embodiments, interactive member 210 may pass through skin 300 to further secure skin 300 to rails 102.

In an exemplary embodiment, the caps 202 are composed of an elastomer and may be snapped, stretched, or pulled over/around rails 102 to couple the caps 202 to the rails 102. Further in the exemplary embodiment, the caps 202 are made of a resilient material, such that the force caused by retention of interactive member 210 within rail 102 causes the cap 202 to bend slightly, and the resiliency of the cap 202 material causes a pressure on skin 300 when the skin 300 is positioned between the cap 202 and the rail 102. In an exemplary embodiment, the caps 202 are formed as a polymer extrusion. In other embodiments, caps 202 are formed as a coextrusion with other polymers or materials to provide additional features on caps 202. Caps 202 may be made of a metal, polymer, composite, wood, or any other suitable material. In the instances where the caps 202 are not generally flexible, the caps 202 may be slid into rails 102 or may feature a joint and/or a locking mechanism to secure the caps 202 to the rails 102. In other embodiments, caps 202 may comprise a hinge or a living hinge (not shown) which may allow caps 202 to be bent or otherwise moved relative to the rails 102 in order to engage or disengage with skin 300. In embodiments where the rails 102 are not generally rectangular in shape, caps 202 may be configured to match the shape of rails 102.

The surface 230 of rail couplers 200 may comprise various shapes, textures, colors, or features. As illustrated in FIG. 3, the surface 230 of rail cap 202*b* is generally rounded in shape, and may function as a bumper or may provide a user with a more comfortable grip on cap 202*b*. Cap 202*b* is configured to couple with rail 102*b*. The surface 230 of rail couplers 200 may be coated with material, such as paint or protective coatings, in order to achieve the desired surface features, or the rail couplers 200 themselves may be formed with varied surfaces 230, for example with a coextrusion process. For example, a multi-color rail coupler 200 may be produced with a coextrusion process. Furthermore, rail couplers 200 may be shaped and textured to meet grab rail compliance requirements (e.g. having a minimum/maximum diameter).

Rail couplers 200 may also be embodied as rail attachments 400. Rail attachments 400 may differ from caps 202 in that rail attachments 400 may not generally extend around at least three sides of rails 102, but may extend around multiple sides of rails 102. As shown in FIG. 2, rail attachments 400 may be used to couple skin 300 to a rail 102 in situations where a cap 202 may not be easily slid around rail 102 (e.g. instances where rail 102 is coupled directly to the deck 20). Skin 300 may be coupled to rail 102 through an interfacing portion of rail attachment 400 in a similar way to cap 202, or the skin may be otherwise attached to rail attachment 400. Rail attachment 400*a* comprises an interactive member 410 configured to interact with the rail 102 to couple rail attachment 400 to rail 102. In the illustrated example, the interactive member 410 is a protrusion that extends into an interior 110 of the rail 102, similar to the interactive member 210 of cap 202.

In an exemplary embodiment, the skin 300 is composed of sheet metal, and may also comprise coatings, paint, decals, other layers of material, or other surface features. In other embodiments, the skin may be composed of any material suitable to make a wall for the pontoon boat 10, including polymers, metals, composites, glass, or wood. In the event that any portion of the skin should be replaced, the rail couplers 200 may be removed from the rails 102 or otherwise moved relative to rails 102, which releases the skin 300. A new skin 300 may then be positioned against the rails 102, and the rail couplers 200 may be coupled onto rails 102, thereby coupling the skin 300 to the rails 102. In this way, the skin 300 may be added, removed, or replaced without having any impact on the rails 102. In other embodiments, an adhesive or a tape may be applied between the skin 300 and the rails 102 and/or the rail couplers 200. For example, double-sided tape may be positioned on the rails 102 or rail couplers 200 before positioning the skin 300 against the rails 102. The tape/adhesive may be configured to provide additional grip or thickness to reduce vibration of the skin 300 when the boat 10 is in use.

As illustrated in FIG. 2, the skin 300 extends generally between two rails 102, illustrated as an upper rail 104 and a lower rail 106. In further illustrated embodiments of rail system 100 where only one rail 102 is depicted, it should be understood that the skin 300 may still extend between two or more rails 102. Any combination of disclosed embodiments of rails 102, or variations thereof, may be used within rail system 100 as upper rails 104, lower rails 106, middle rails 105, support rails 500, or any a rail in any other position within the frame. Furthermore, any disclosed embodiments of support rails 500 may be used as rails 102. Any features illustrated or otherwise disclosed as being part of an upper rail 104, lower rail 106, middle rail 105, or support rail 500 may also be included on any other type of rail in rail system 100.

Figure 4:
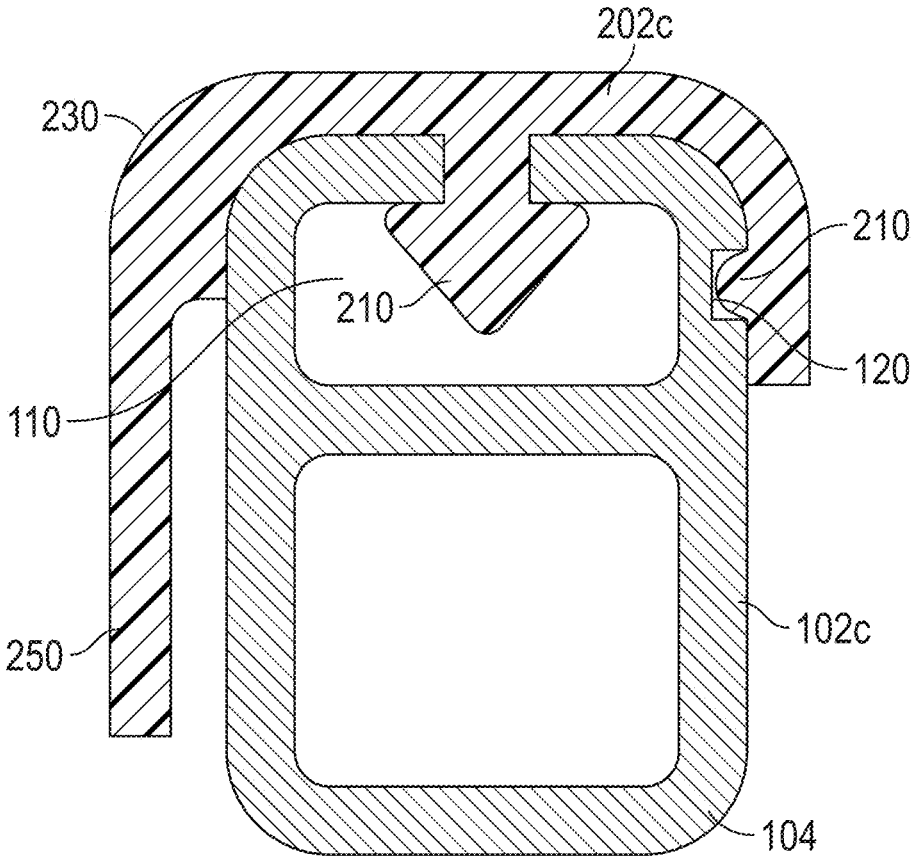
FIG. 4 illustrates a sectional view of a further upper rail and associated rail cap.

Referring to FIG. 4, the interactive member 210 of cap 202 may include a protrusion, configured to couple the cap 202 to the rail 102 through an exterior coupling instead of being received in the interior of the rail 102. The rail 102 may comprise an external coupling feature 120 to interact with interactive member 210. In the illustrated embodiment, cap 202*c* comprises two interactive members 210, an interior protrusion configured to couple to rail 102 by entering the interior 110 of rail 102*c*, as well as an exterior protrusion configured to couple to rail 102*c* by interfacing with an exterior coupling feature 120. The interactive members 210 may also be described as cap coupling features, as they may assist in coupling cap 202 to rail 102. Similarly, interior features (the walls of interior 110), exterior coupling features 120, and pocket 180 (described below) may be described as rail coupling features, as they may also assist in coupling the cap 202 to the rail 102. In other embodiments, cap coupling features and rail coupling features may be any compatible systems for coupling the cap 202 to the rail 102. Examples of coupling features include snaps, buttons, zippers, locks, detents, joints, adhesives, staples, or other common coupling devices as are known in the art. In another example, the rail 102 may comprise protrusions and the cap 202 may comprise recesses to receive protrusions.

Figure 6:
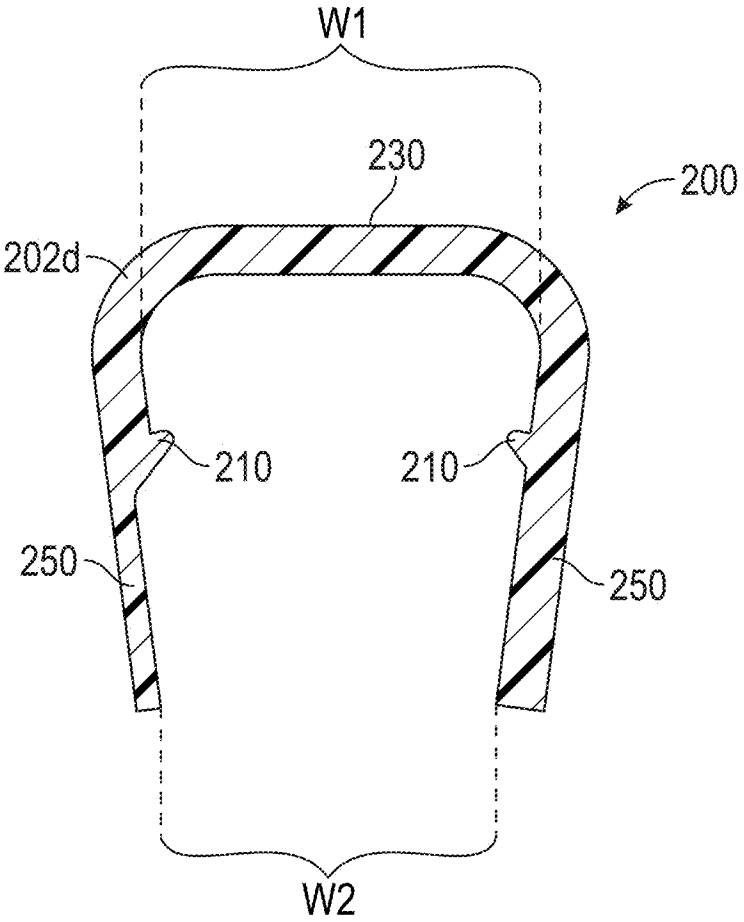
FIG. 6 illustrates a sectional view of the associated rail cap of FIG. 5 removed from the upper rail of FIG. 5.
Figure 5:
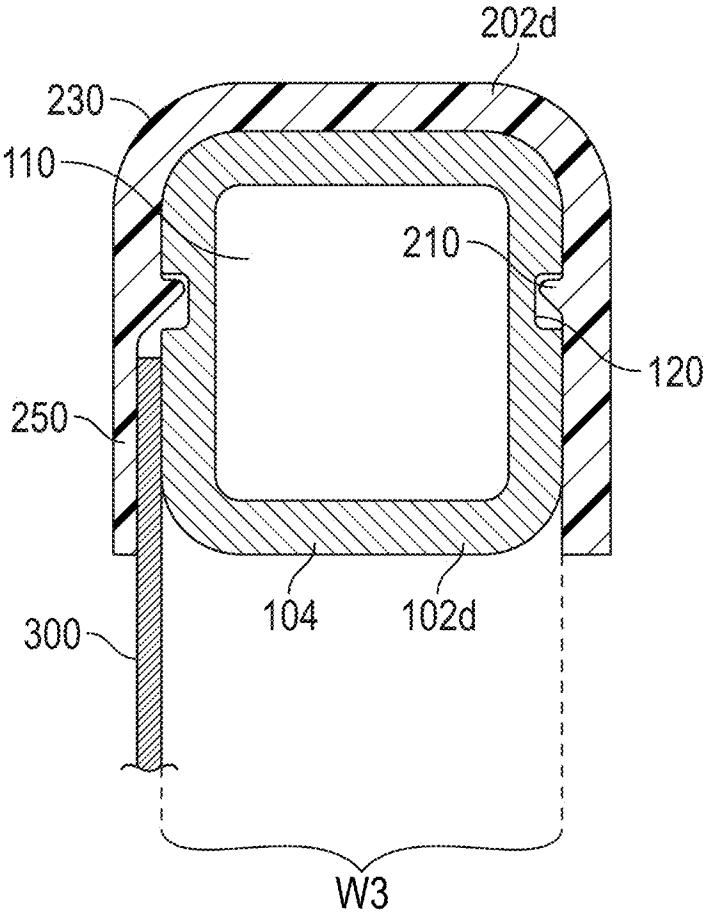
FIG. 5 illustrates a sectional view of still another upper rail and associated rail cap.

Referring now to FIGS. 5-6, the interactive members 210 of rail coupler 200 may only comprise exterior protrusions as the cap coupling features, and rail 102*d* accordingly only comprises exterior coupling features 120 as rail coupling features, as shown in the exemplary cap 202*d*. In the illustrated embodiment, interactive members 210 are at least partially curved to assist in positioning the interactive members 210 within exterior coupling features 120. In such an embodiment, the cap 202*d* may be flexed/deformed to stretch around the rail 102*d* in order to couple the cap 202*d* to the rail 102. Once coupled to the rail 102*d*, cap 202*d* may be removed by flexing the cap 202*d* to a point at which an end of interactive members 210 exit the exterior coupling features 120. In this way, the cap 202*d* is retained on rail 102*d* until an outward force is applied. As shown in FIG. 5, the entire cap 202*d* may be shaped such that the ends of cap 202*d* angle inward toward one another. As illustrated, the cap 202*d* comprises a first width W1 and a second width W2, and the rail 102*d* comprises a third width W3 wherein W1 and W3 are greater than W2. W3 may be less than or equal to W1. Such a configuration allows for the resiliency of the material within cap 202*d* to cause the interface portions 250 to press against the skin 300 and rail 102. FIG. 4 illustrates only one skin 300 coupled to rail 102, but in other embodiments another skin 300 may be located on the opposing side of rail 102 to form a double walled system. The skin 300 on the opposing side may be coupled to rail 102 with any combination of interactive members 210 and interface portions 250.

Figure 8:
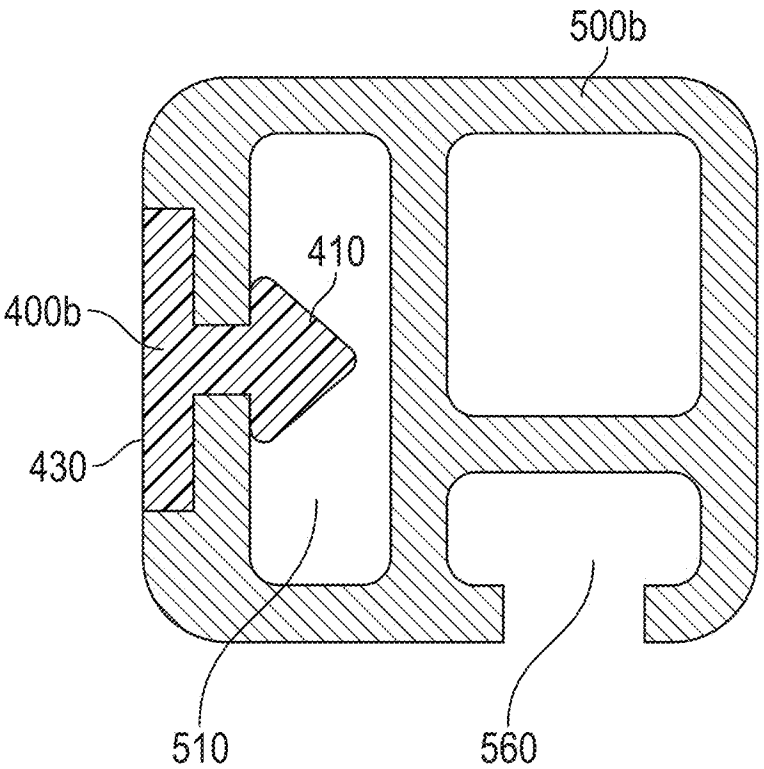
FIG. 8 illustrates a sectional view of another exemplary rail and another rail attachment.
Figure 7:
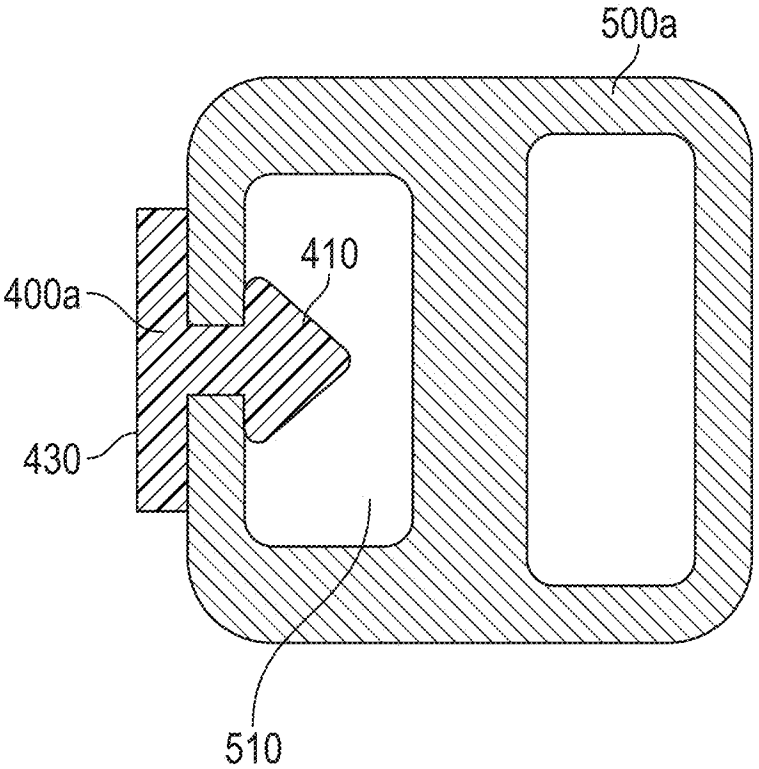
FIG. 7 illustrates a sectional view of an exemplary rail and rail attachment.

Referring to FIGS. 7-8, sectional views of support rails 500 are shown. As mentioned previously, the cross sections and features shown in FIGS. 7-8 may also be used for rails 102, and the sections shown in FIGS. 2-5 may be used for support rails 500. Support rails 500 may be positioned at various points along rail system 100 to support rails 102, and any other rails or features within rail system 100. Support rails 500 may be made from similar or identical materials and methods as rails 102. In the illustrated embodiments, support rails 500 may be configured to accept rail attachments 400 or any rail coupler 200. Similar to interactive members 210, rail attachments 400 may couple to support rails 500 by inserting an interactive member 410 into a support rail interior 510. Furthermore, as was the case with cap and rail coupling features, the rail attachment 400 may be coupled to the support rail 500 through any appropriate coupling mechanisms. Rail attachment 400 may also comprise an exterior surface 430, which may comprise various colors, accents, paint, coatings, textures, or other external features. Furthermore, rail attachment 400 may be a bumper or a rubber insert. As exemplified in the figures, rail attachment 400*a* may extend beyond the surface of support rail 500*a* (FIG. 6), may be flush with the surface of support rail 500*b* as exemplified in rail attachment 400*b* (FIG. 7), or may be recessed relative to the surface of the support rail 500. It should be recognized that rails 102 may comprise similar attachment features/rail connectors to support rails 500 in order to attach additional attachments to rails 102. For example, support rail 500*b* comprises a support rail coupling feature 560 configured to couple with external attachments. Rail couplers 200 such as rail attachments 400 may be attached, detached, or otherwise moved relative to rails 102 such as support rails 500 without disassembling the rails 102 themselves or the rail system 100.

Figure 9:
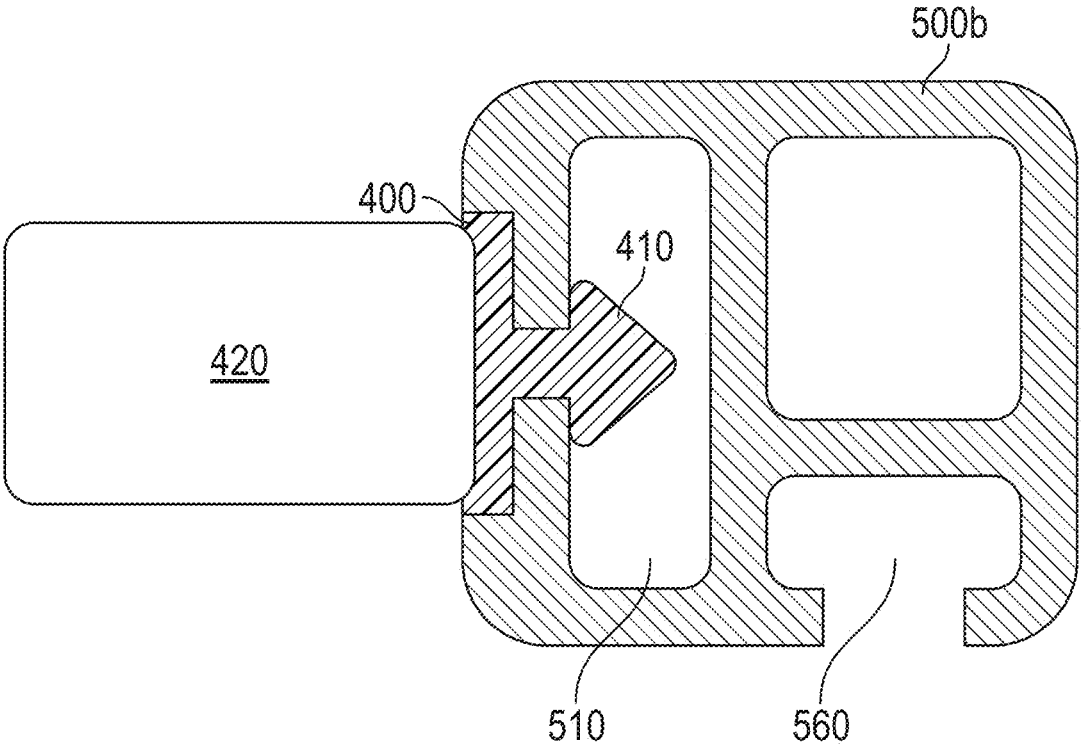
FIG. 9 illustrates a further sectional view of an exemplary rail and an attachment device.

Referring to FIG. 9, rail 102, in this embodiment illustrated as a support rail 500*b*, may be coupled with an attachment device 420. Attachment device 420 may be any device a user or manufacture may desire to attach to rail 102. Exemplary attachment devices 420 include position sensors (sonar, IR, etc.), motion sensors, light sensors, lighting systems, speakers, cameras, mirrors, cup holders, fishing rod holders, coolers, ornamental decorations, recreational devices (e.g. a basketball hoop), extendable tables/countertops, or any other suitable attachment device. In the illustrated embodiment, attachment device 420 is coupled to the rail 500*b* through rail attachment 400 and interactive member 410. In such an embodiment, the attachment device 420 may be configured to slide along an axis parallel to the rail 102 to which it is attached. For example, an attachment device 420 coupled to a top rail 104, may be configured to slide generally horizontally along the top rail 104, but may be restricted from moving vertically relative to top rail 104. In yet other embodiments, attachment device 420 may be locked into a single position. In still yet other embodiments, attachment device 420 may be configured to couple to any rail 102 through any of the coupling devices disclosed herein. Attachment device 420 may couple to a rail 102 through a coupling mechanism integral to the attachment device 420, or through a rail coupler 200. In embodiments, attachment device 420 may be a "LOCK-N-RIDE" coupler to attach an accessory such as position sensors (sonar, IR, etc.), motion sensors, light sensors, lighting systems, speakers, cameras, mirrors, cup holders, fishing rod holders, coolers, ornamental decorations, recreational devices (e.g. a basketball hoop), extendable tables/countertops to rail system 100. Additional details regarding the "LOCK-N-RIDE" coupler are found in U.S. Pat. No. 7,222,582, the disclosure of which is incorporated herein by reference. Rail system 100 would include opening sized and shaped to cooperate with the "LOCK-N-RIDE" coupler.

Figure 10:
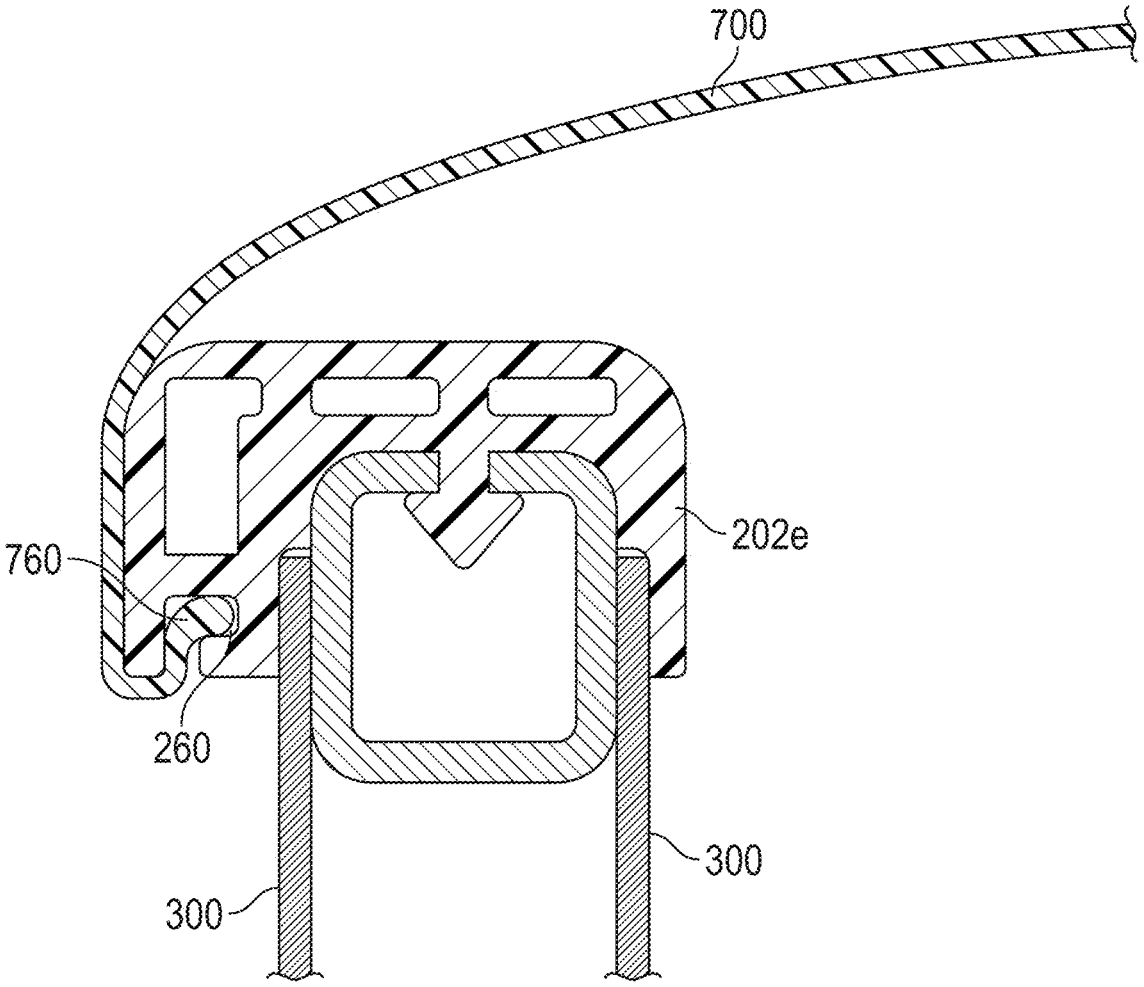
FIG. 10 illustrates a further still rail cap securing an outer skin and an inner skin to an upper rail and including an attachment feature securing an accessory, a cover to the enclosure.

Referring to FIG. 10, cap 202*e* may also comprise attachment features. In the illustrated embodiment, rail cap 202*e* comprises a cap attachment feature 260 that is configured to couple with an attachment feature 760 on a cover 700 for boat 10. Cover 700 may couple to rail 102 through cap 202*e* and may be used to provide shade or other forms of cover on boat 10. Cap attachment feature 260 may also be configured to couple with other attachments such as bumpers, facades, colored accents, lighting, etc.

Figure 11:
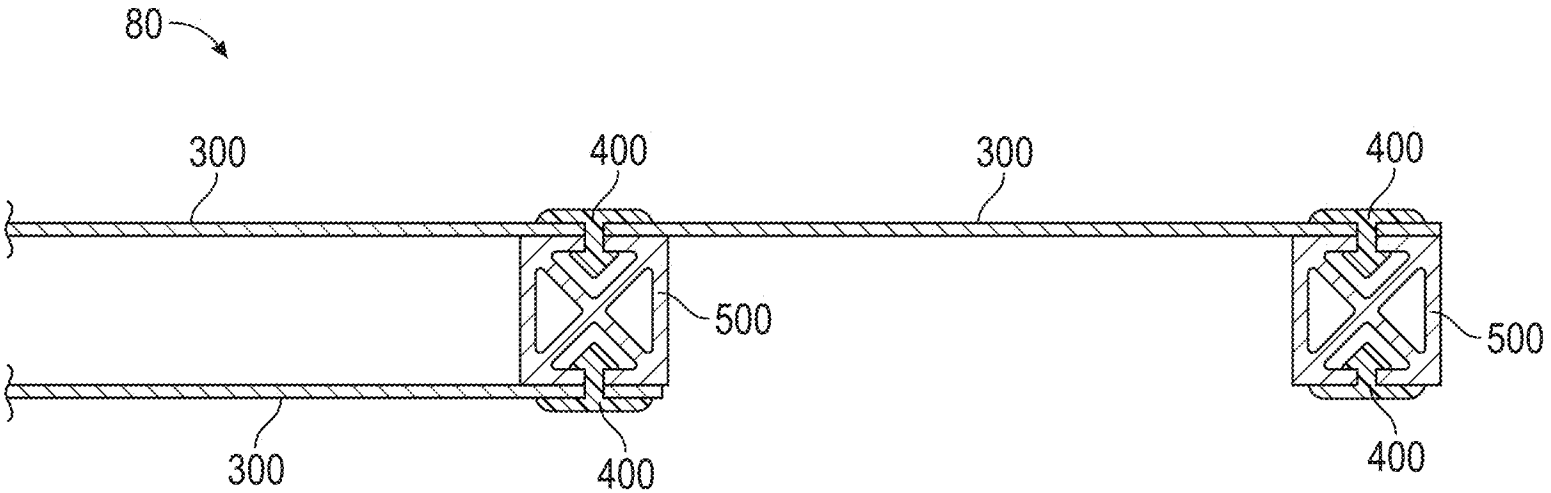
FIG. 11 illustrates a sectional view along a portion of line L1 or L2 in FIG. 1.

Referring to FIG. 11, a cross-sectional view of an exemplary version of rail system 100 is shown. As shown, the rail system 100 may comprise an exterior and an interior skin 300 with each skin coupled to an opposing side of support rails 500, or may comprise only a single skin 300. The interior and exterior skins 300 may be composed of different materials, and may have different features such as paints, coatings, textures, shapes, and corrugations. In sections where there is no skin 300 attached to support rails 500, rail couplers 200 such as rail attachments 400 (e.g. rubber stoppers/bumpers) may be attached. Rail attachments 400 may also be included between multiple skins 300 or over a portion of one skin 300. Furthermore, fasteners such as rivets or staples may be used to secure skins 300 to support rails 500.

Figure 12:
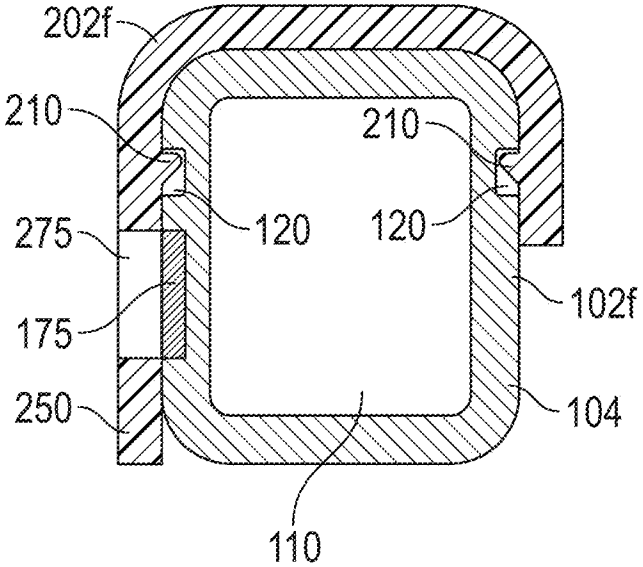
FIG. 12 illustrates a sectional view of another exemplary rail, an internal light, and another rail attachment.

Referring now to FIG. 12, yet another embodiment of a rail coupler 200 and rail 102 is illustrated. As illustrated, the rail coupler 200 in FIG. 11 is rail cap 202*f*, which is similar to rail cap 202*d*, but additionally comprises a transparent or translucent portion 275 between interface portion 250 and interactive member 210. The rail 102*f* includes a recess in which an illumination source 175 is received. The illumination source 175 is positioned generally next to transparent portion 275 of rail cap 202*d* and is configured to shine through transparent portion 275. In other embodiments, the illumination source 175 may be positioned on the bottom of a rail 102, or may be otherwise angled downward to provide illumination in a downward direction (e.g. courtesy lights) instead of/in addition to illumination in an outward direction. In such embodiments, the rail cap 202 may extend around the bottom of the rail 102 to secure the illumination source 175 to the rail 102, and the transparent portion 275 may be positioned on the bottom face of the rail cap 202. Additionally, the cap 202 may not extend around the bottom of the rail 102, and the illumination source 175 may be otherwise secured to the rail 102, such that the illumination source 175 may shine without passing through a transparent portion 275. The illumination source 175 and transparent portion 275 may extend along the entirety of rail 102*f* and cap 202*f* respectively, or they may be positioned at discrete points along rail 102*f* and cap 202*f*. In an exemplary embodiment, transparent portion 275 is a generally clear or transparent material within cap 202*f*, and the illumination source 175 is an LED strip coupled to the rail 102*f*. In other embodiments, transparent portion 275 may be an additional element such as glass, an additional transparent polymer, or another form of window that is coupled to cap 202*f*. Furthermore, transparent portion 275 may extend throughout any portion of the cap 202*f* including the entirety of cap 202*f*. Such an embodiment would allow a user to see other portions the rail 102*f* including other features on the surface of rail 102*f* beneath the cap 202*f*.

In yet other embodiments, transparent portion 275 may provide visible access to colored portions or accents of rail 102*f* instead of an illumination source 175. The illumination source 175 may be any device configured to emit light, such as lightbulbs or other phosphorescent, fluorescent, or luminescent materials. Furthermore, illumination source 175 may be movable relative to the rail 102*f* such that the illumination source 175 may be replaced or removed. Illumination source 175 may also be programmable to shine with different colors, as is known in the art. Illumination source 175 may be coupled to rail 102*f* through adhesives, or by the cap 202*f*. Interior 110 of rail 102*f* may comprise wires, power sources, or other electronic components to electrically couple to illumination source 175. In embodiments, transparent portion 275 is coextruded with the remainder of cap 202*f*.

Figure 13:
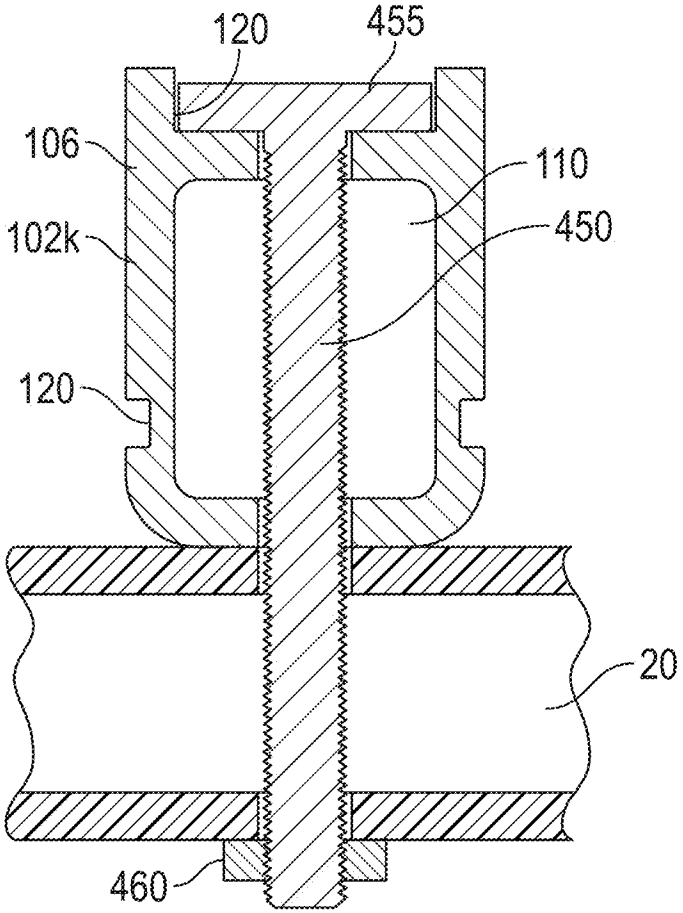
FIG. 13 illustrates a sectional view of a lower rail and a rail fastener.

Referring to FIG. 13, another embodiment of a lower rail 106 is disclosed. Rail 102*k* is configured to be coupled to the deck 20 of the boat 10 through rail fasteners 450. In the illustrated embodiment, fastener 450 is a screw with a head 455, the head 455 configured to interface with an exterior coupling feature 120 of the rail 102*k*. The fastener 450 extends from the head 455 through the interior 110 of rail 102*k* and into deck 20. The fastener 450 may be coupled to the deck 20 of the boat through a nut and washer 460. In an exemplary embodiment, a number of holes are drilled into the deck 20, a rail coupler 200 and a lower rail 106 are positioned along the holes, and fasteners 450 are then used to couple the lower rail 106 and coupler 200 to the deck 20 through the holes. Rail 102*k* also comprises additional exterior coupling features 120 to couple with rail couplers 200. In other embodiments, fastener 450 may be a rivet, bolt, nail, staple, or other mechanism configured to couple a rail 102 to the boat 10.

Figure 14:
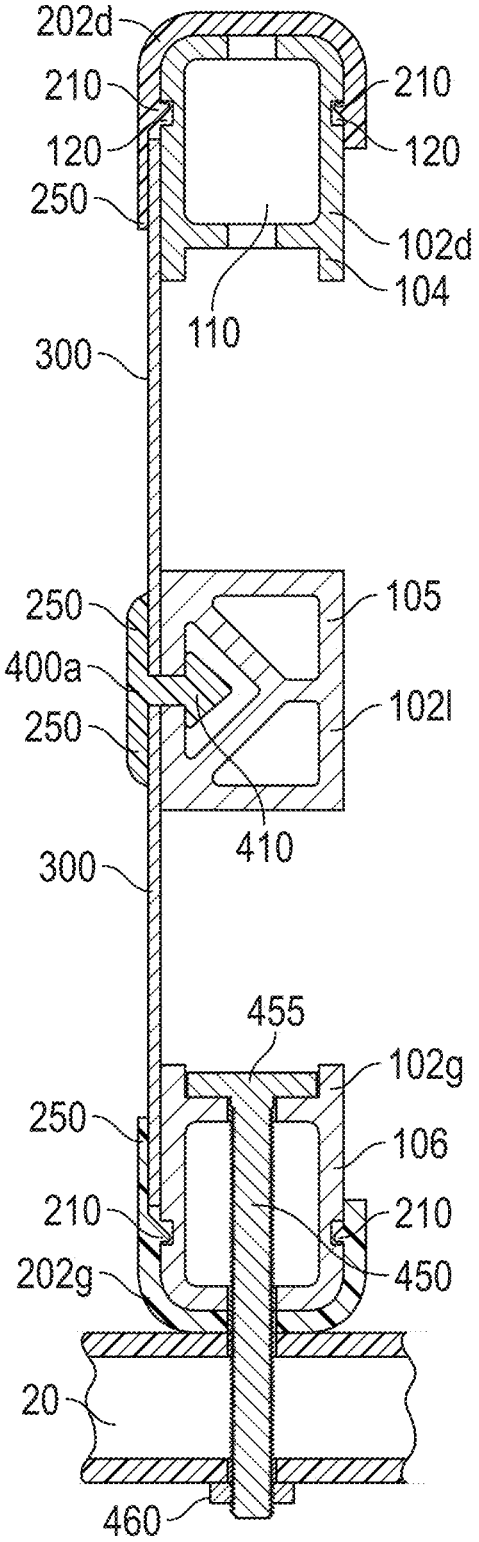
FIG. 14 illustrates a sectional view of along a portion of line L1 in FIG. 1 for a system with a middle rail between an upper rail and a lower rail.
Figure 15:
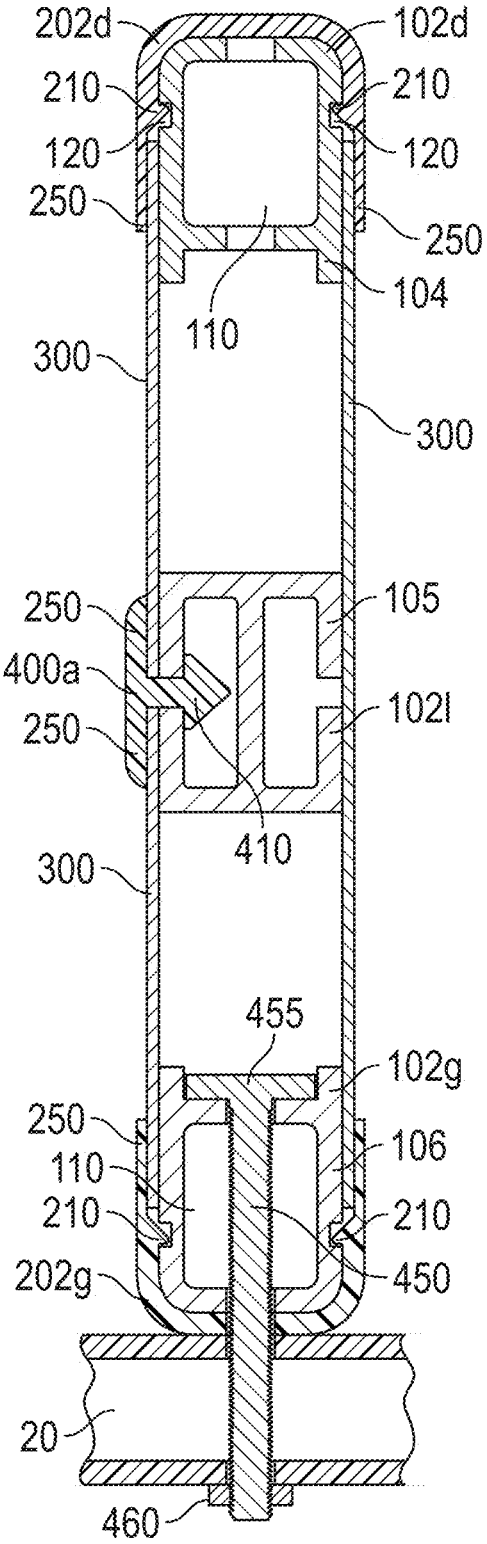
FIG. 15 illustrates the sectional view of FIG. 13 with a double skin system.

Referring now to FIGS. 14-15, exemplary sectional views of an enclosure system 80 are shown, comprising an upper rail 104, a middle rail 105, and a lower rail 106. In the illustrated embodiment, skins 300 extend between the upper rail 104 and the middle rail 105, as well as between the middle rail 105 and the lower rail 106. Any embodiments of rails 102 may be used for the upper rail 104, middle rail 105, and lower rail 106. In the illustrated embodiment, lower rail 106 is coupled to the deck 20 through fastener 450. Furthermore, lower rail 106 is illustrated as rail 102*g* configured to couple with cap 202*g*. Cap 202*g* may be coupled to rail 102*g* before the rail 102*g* is coupled to the deck 20 through fastener 450, and fastener 450 may extend through cap 202*g*. Cap 202*g* may be configured similarly to cap 202*d*, but with an additional opening to accommodate passage of fastener 450 through the cap 202*g*. The skin 300 may be coupled to the lower rail 106 by bending the interface portion 250 of cap 202*g* away from rail 102*g*. Furthermore, lower rail 106 may be coupled to deck 20 before or after the skin 300 is coupled to lower rail 106.

FIG. 15 illustrates a similar embodiment to FIG. 13, but with an additional skin 300 positioned on the interior of enclosure system 80. As illustrated, skin 300 may extend across the entire height of the enclosure system 80 as a single piece, or may be composed of multiple pieces of skin 300. In the illustrated embodiment, the middle rail 105 is configured to receive rail attachments 400 on both sides of rail 102*l*. Accordingly, rail 102*l* may couple to zero, one, or two skins 300 through rail attachment 400.

Figure 17:
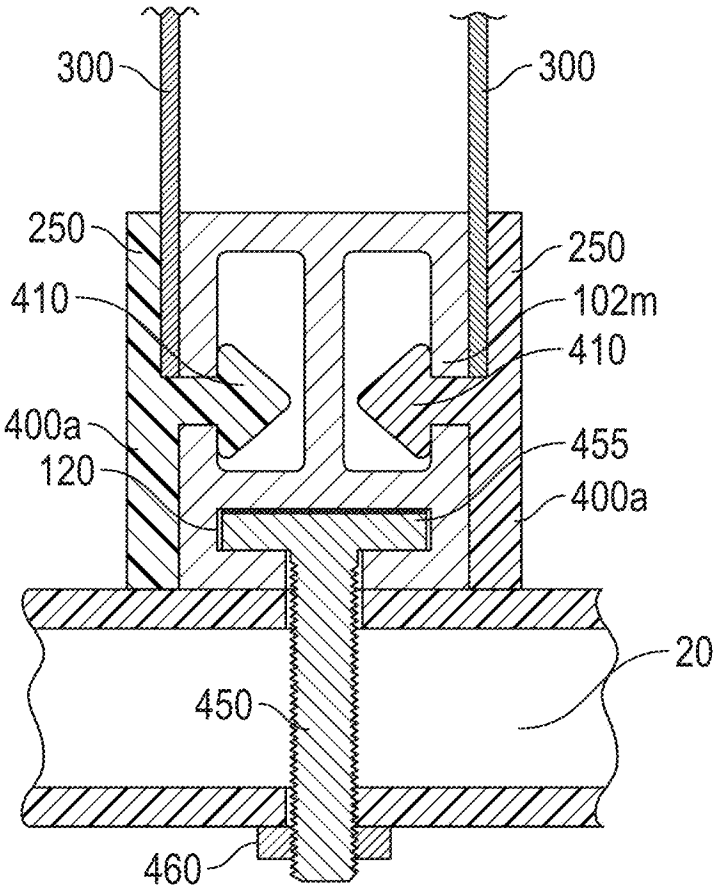
FIG. 17 illustrates a sectional view of yet another lower rail with two lower rail couplers and rail fastener.
Figure 16:
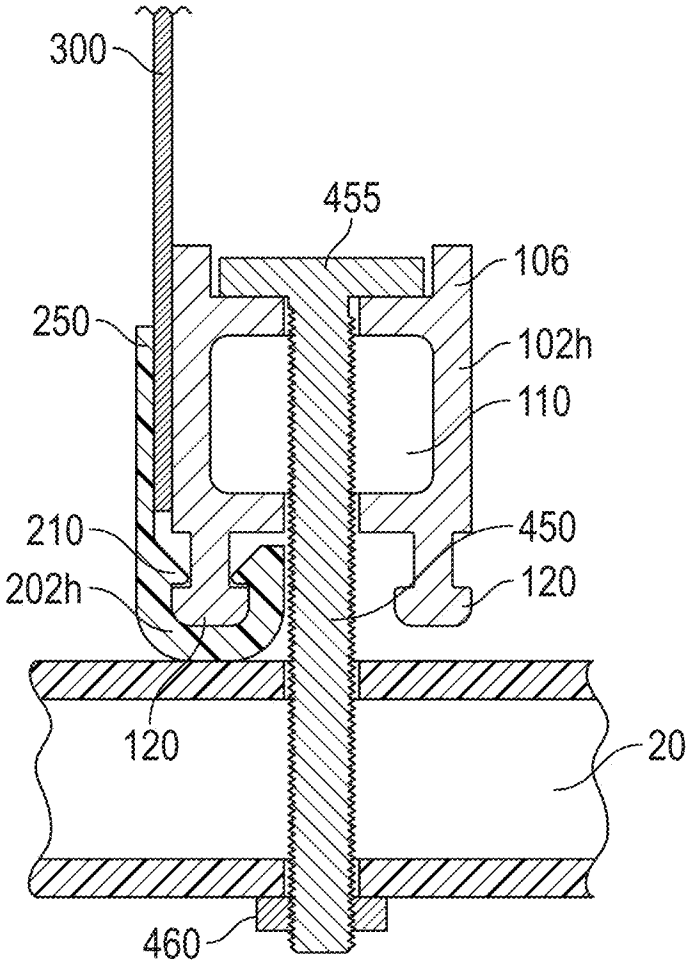
FIG. 16 illustrates a sectional view of another lower rail and a lower rail coupler and rail fastener.

FIGS. 16-17 illustrate various embodiments of lower rail 106. In FIG. 15, rail 102*h* comprises an external rail coupling feature 120, which is illustrated as a protrusion. In the exemplary embodiment, cap 202*h* comprises a number of interactive members 210 configured to interact with external rail coupling feature 120 to couple the cap 202*h* to the rail 102*h*. In this embodiment, the fastener 450 may not pass through the rail coupler 200 on the lower rail 106, and the rail coupler 200 could be coupled to the rail 102 after the rail 202*h* was fastened to the deck 20. The cap 202*h* may be coupled to rail 102*h* by bending or sliding a portion of cap 202*h* around the interactive member 210.

As shown in FIG. 17, lower rail 106 may also be configured in a similar fashion to rail 102*l*, and may be configured to couple with a number of rail attachments 400 through interactive members 210 configured to be protrusions. In this embodiment, rail 102*m* comprises an external coupling feature 120 configured to receive the head 455 of fastener 450. Similar to rail 102*h*, rail 102*m* allows for the attachment of rail couplers 200 to the rail 102 without interfering with the fastener 450. Rail attachments 400 may be coupled to rail 102*m* before or after the rail 102*m* has been coupled to the deck 20 through fastener 450. Fastener 450 may also be configured to extend through rail 102*m* in a manner similar to rails 102*h* and 102*k*.

Figure 19:
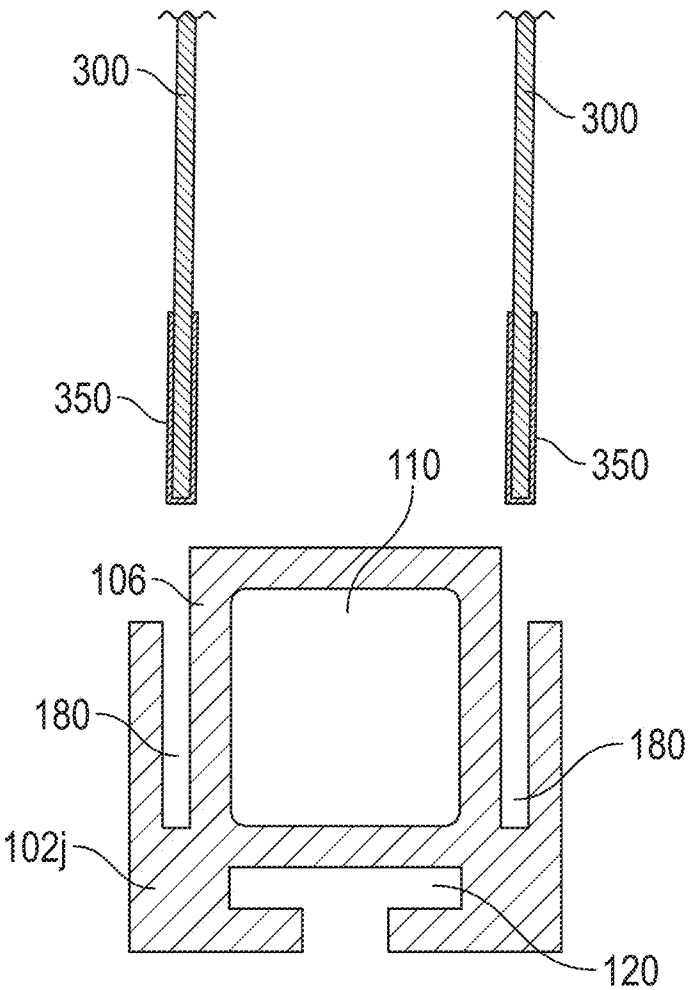
FIG. 19 illustrates a sectional view of still yet another exemplary rail and an outer skin.
Figure 18:
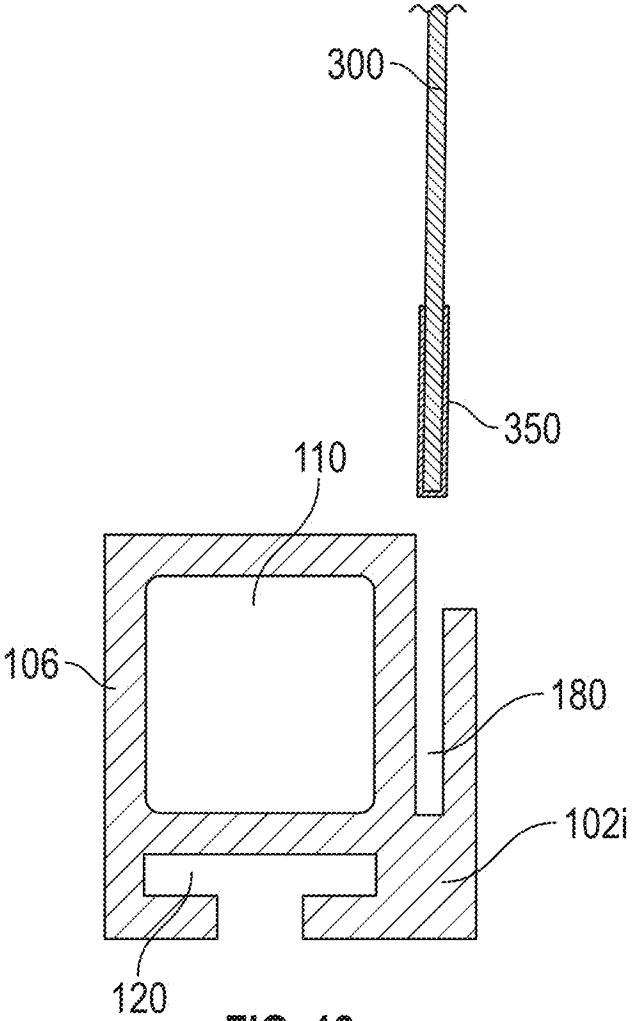
FIG. 18 illustrates a sectional view of yet another exemplary rail.

Referring to FIGS. 18-19, other embodiments of rails 102 are shown. Both rails 102*i* and 102*j* comprise an exterior pocket 180 configured to interface with the skin 300. Skin 300 may be inserted into exterior pocket 180 to couple the skin 300 to the rail 102 without a rail coupler 200. As shown in FIG. 18, skin 300 may comprise tape or an adhesive 350 to secure the skin 300 within the pocket 180 and prevent movement of skin 300 within pocket 180. The tape 350 may be single sided tape and may primarily provide additional thickness to the skin 300, or the tape 350 may be double sided tape to provide both thickness and adhesion. Both rails 102*i* and 102*j* comprise exterior coupling features 120 which may be configured to couple the rails 102*i* and 102*j* to the deck 20 through fastener 450. Rail couplers 200 may still be coupled to rails 102*i* and 102*j*. Different sides of rails 102 may comprise different features, such as external coupling features 120 or pockets 180 to couple with skin 300 or other attachments as needed. Accordingly, any of the features shown in any of the rails 102*a-m* may be used in combination with any other embodiment of rails 102*a-m*. In embodiments, rail couplers are also included to further secure skin(s) 300 to rails 102*i* and 102*j*, to provide protection to rails or skins, and/or to provide accent color or lighting features to boat 10.

Figure 20:
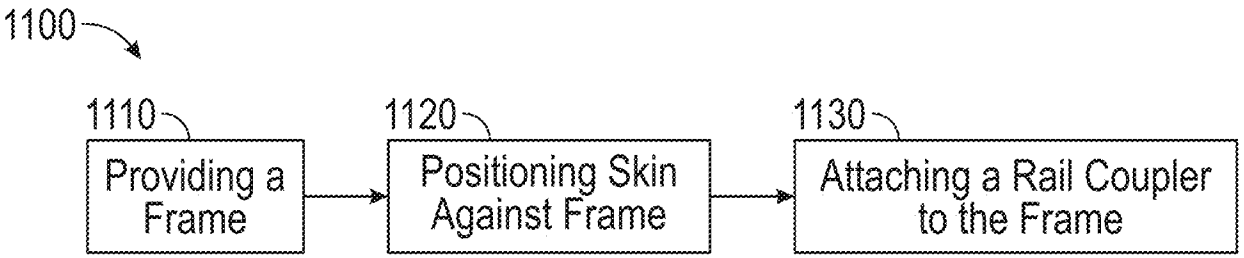
FIG. 20 illustrates a flow chart for method of attaching a skin to a frame.
Figure 21:
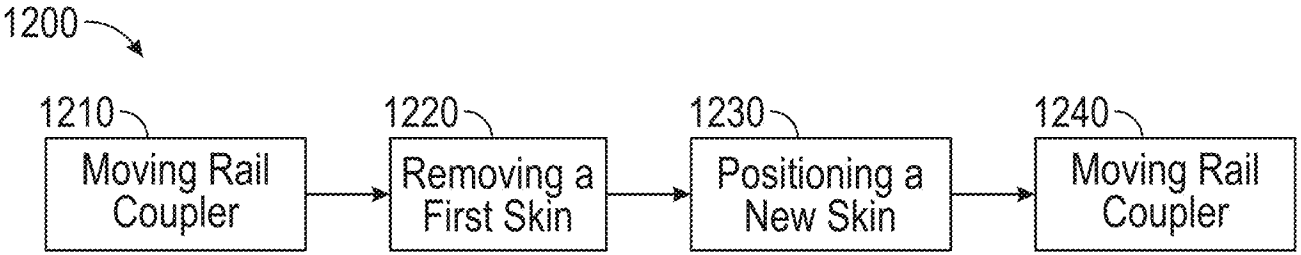
FIG. 21 illustrates a flow chart for a method of replacing a skin on a frame.

Referring to FIGS. 20-21, methods for adding a skin 300 to an enclosure system 80 of a boat 10 are shown. Addition method 1100 discloses the steps of providing a frame 1100, placing skin against the frame 1120, and then attaching a rail coupler to the frame 1130. The frame of step 1100 may be the rail system 100, otherwise referred to as a frame or skeletal system as disclosed above. The skin 300 is then positioned against the frame 100 along at least one side of the rails 102 of the frame 100, and then a rail coupler 200 is coupled/attached to the frame 100. When the rail coupler 200 is attached to the rails 102 of frame 100, the skin 300 is positioned between the rail coupler 200 and the rail 102 as discussed above and shown in the illustrated embodiments. In an exemplary embodiment, the rail coupler 200 is movable relative to the frame 100 and accordingly may be removed or attached to allow for the decoupling or coupling respectively of skin 300 to frame 100 without dismantling or moving the frame 100 relative to the boat 10.

A skin 300 may be removed and replaced through replacement method 1200. Replacement method 1200 comprises the steps of moving a rail coupler 1210, removing a first skin 1220, positioning a new skin 1230, and moving a rail coupler 1240. In this process, a rail coupler 200 is first moved relative to the frame 100 to allow for the removal of the skin 300. The moving of rail coupler 200 may comprise the steps of decoupling the rail coupler 200 from the rail 102, or otherwise bending or moving the rail coupler 200 away from the rail 102 to allow for the removal of skin 300. In some embodiments, the rail coupler 200 may even be broken, in which case a new rail coupler 200 would be used in step 1240. Once the first skin 300 is removed, a new skin 300 may be positioned along the frame 100, and a rail coupler 200 may be coupled to the frame 100 to couple the new skin 300 to the frame 100. The rail coupler 200 that is attached may be a new rail coupler 200 or the original rail coupler 200 from the first step 1210.

Figure 22:
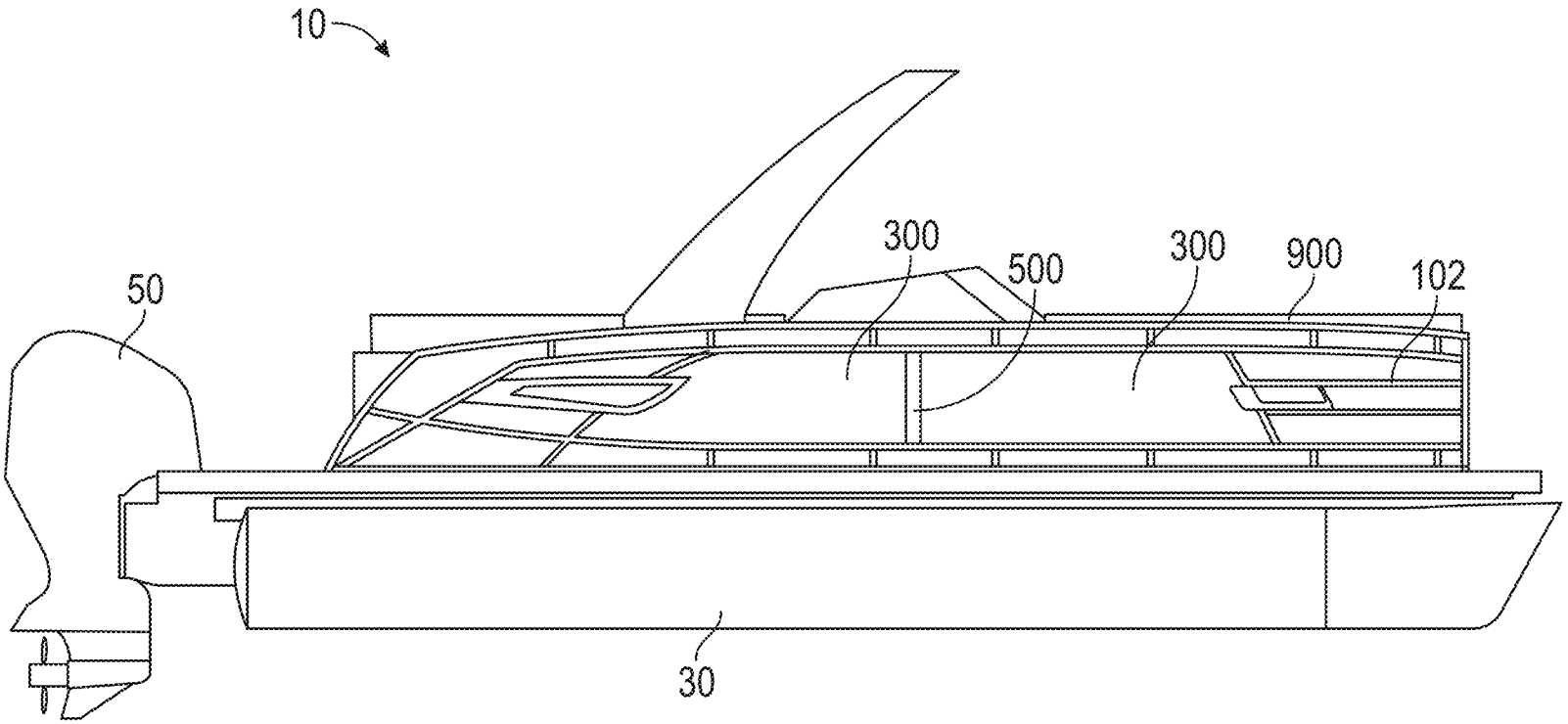
FIG. 22 illustrates a side view of a pontoon boat including a first exemplary enclosure system.

Referring to FIG. 22, a pontoon boat 10 is disclosed with colored accent features. Since caps 202 and rail attachments 400 may be added or removed without dismantling the rail system 100, users have a large degree of customizability regarding the exterior of the boat 10. Colored accents 900 may be added onto the boat 10 as part of the cap 202, or as an attachment similar to rail attachments 400. In FIG. 22, colored accent 900 extends generally along the top rail. Pontoon boat 10 also may comprise additional horizontal rails 102 which may be configured to receive attachments in a similar manner to rail attachments 400.

Referring to FIGS. 23-56, additional embodiments of fencing systems having modular components are illustrated.

Figure 23:
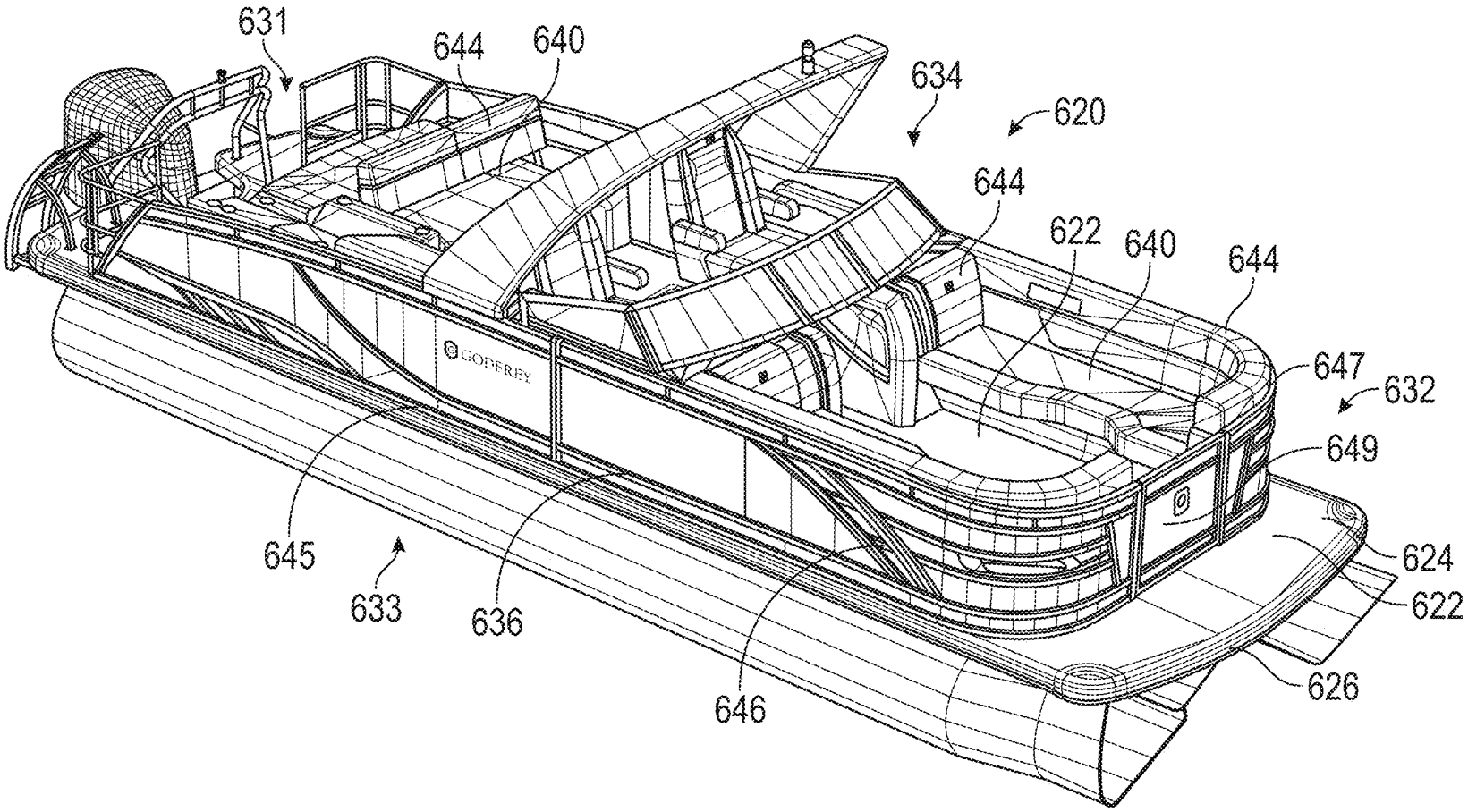
FIG. 23 illustrates a perspective view of a pontoon boat with another exemplary enclosure system.

Referring to FIG. 23, a pontoon boat 620 generally has a deck 622 with an upper deck surface 624 and a deck periphery 626. Pontoons 628 are mounted to a bottom side of the deck. The pontoon boat has a stern 631, a bow 632, a starboard side 633, and a port side 634. Fencing 636 mounted on the deck defines a passenger area 640 that includes pontoon boat furniture 644, including seating components and storage components. The fencing extends around the deck periphery 626 and includes a plurality of fencing sections 645, 646, 647, with a door 649 mounted between fencing sections.

Figure 24:
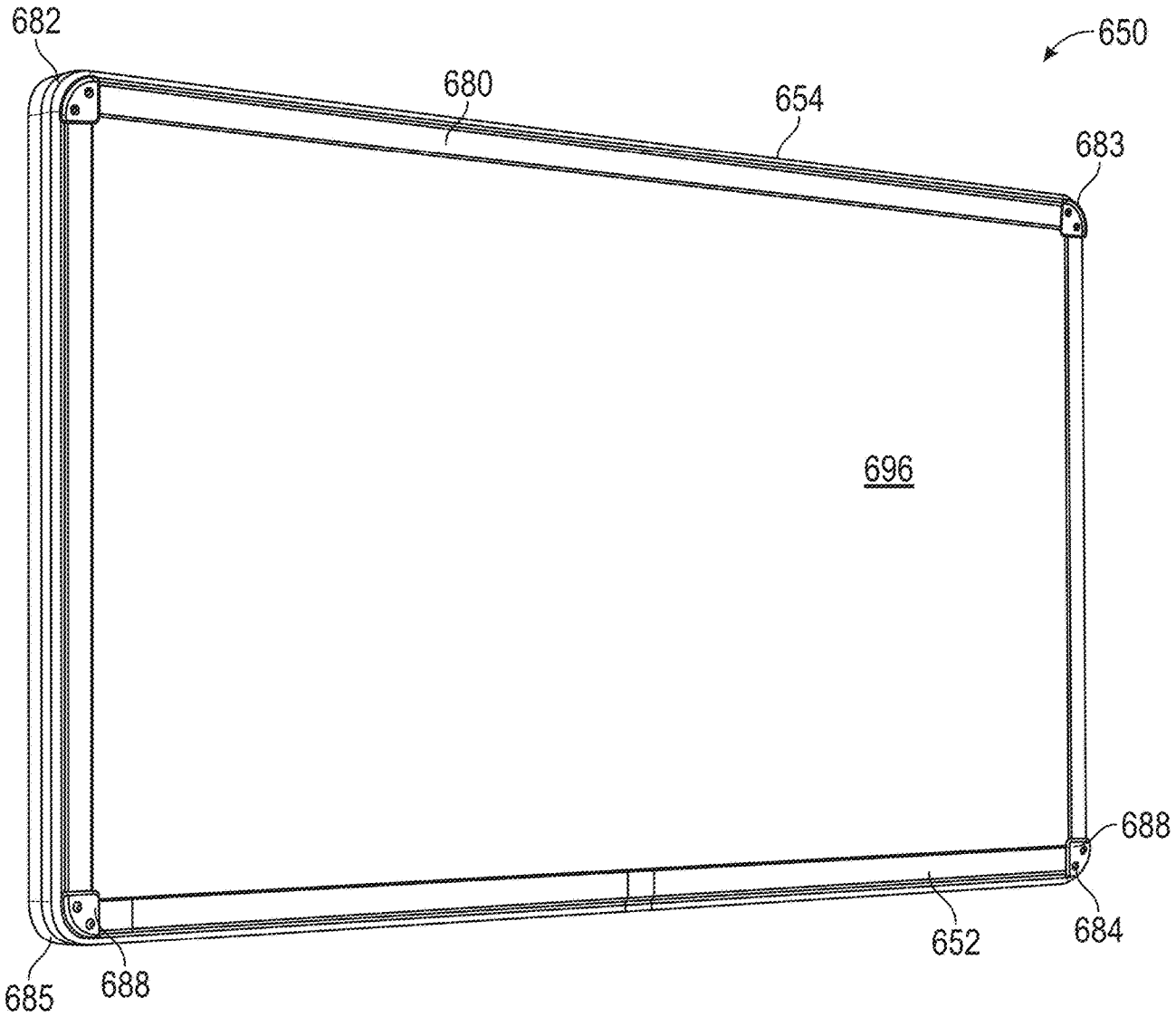
FIG. 24 is a perspective view of a fencing section in accord with embodiments.
Figure 25:
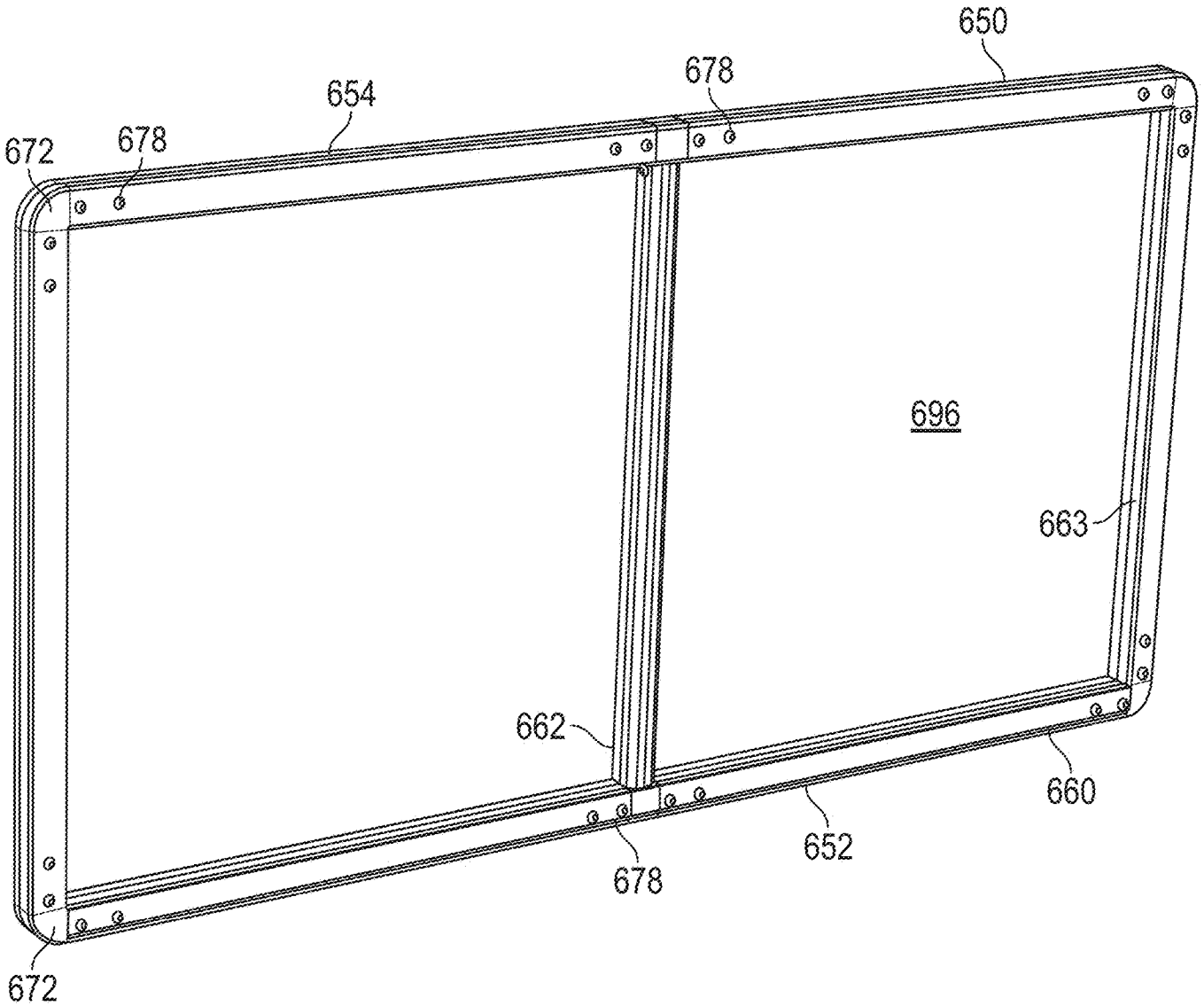
FIG. 25 is a perspective view of the fencing section of FIG. 24 taken from the opposite side from that of FIG. 24.
Figure 26:
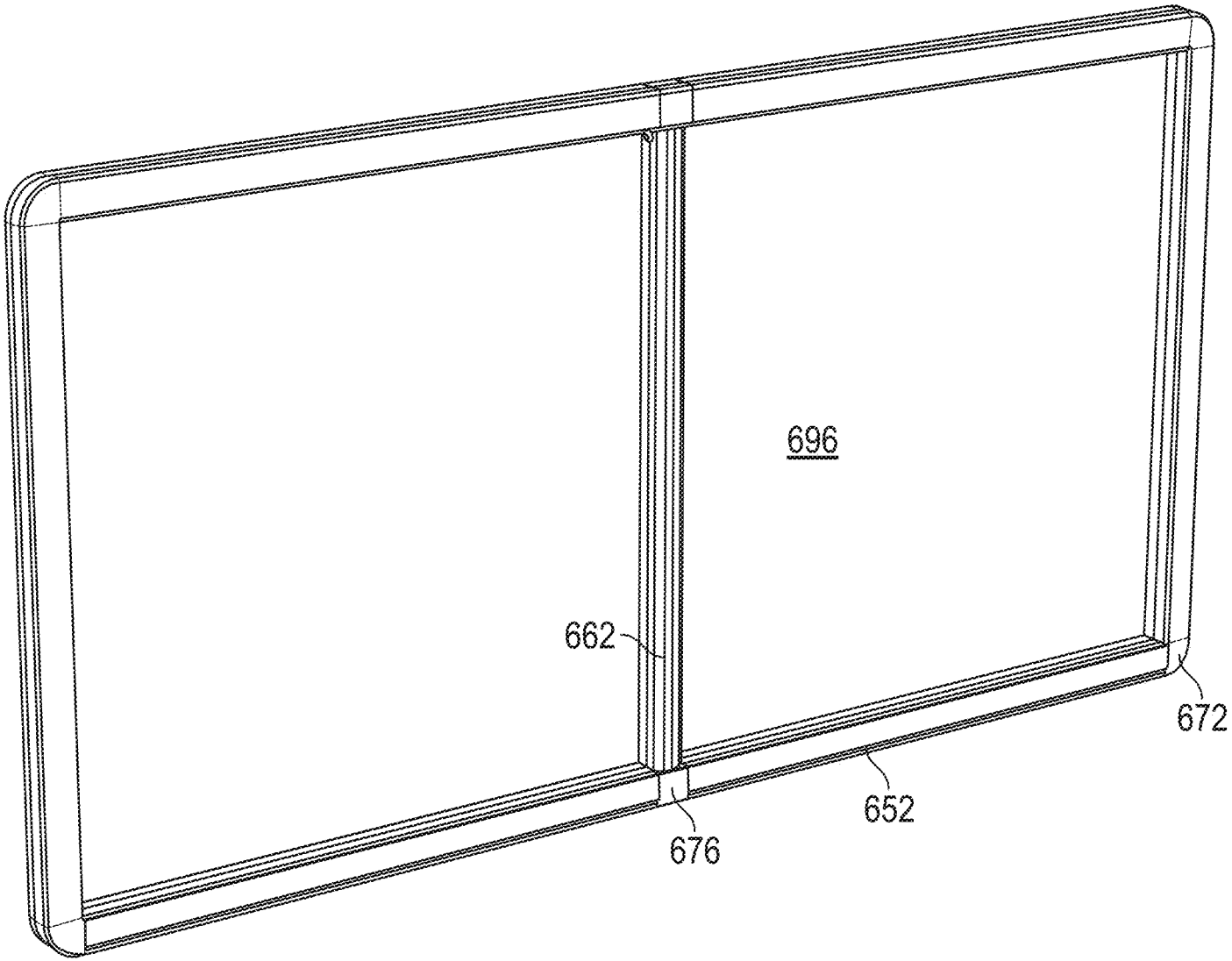
FIG. 26 is the same side of the fencing section as shown in FIG. 25 but the screws securing the tubing segments to the segment connectors are present on the opposite side.

FIGS. 24-26 illustrate a rectangular shaped fencing section 650 that has a lowermost base rail 652 that seats on or confronts the deck of the pontoon and may be attached directly thereto, such as with bolts extending through the deck, and an uppermost rail 654 that defines the top of the fencing. Upright rails 655, 656 extend between the base rail and the uppermost rail forming the fencing framework 661 that retains the paneling 661, or the skin of the fencing. Either side, the side shown in FIG. 24, or the side shown in FIGS. 25 and 26, may suitably face outward on the pontoon boat. That is, the skin may be attached on the side of the fencing framework facing away from the pontoon boat, or the skin may be attached on the side of the fencing framework facing inward toward the passenger region. Adjacent fencing sections on the pontoon boat may be connected in conventional manners, for example with connectors extending through adjacent upright rails. FIGS. 25 and 26 illustrate the fasteners securing the tubular segments to the segment connector inserts may be on either side of the fencing section.

Continuing to refer to FIGS. 24-26, and to FIGS. 27-31, in embodiments, the fencing framework may comprise additional modular components. The rails are configured as aluminum extrusions cut to tubular segments 662, 663; the segments each having end portions 664, 666 with open ends 667, 668. Segment connectors 672, 676 connect the segments together, the segment connectors may have an interference fit with the open ends of the tubular segments. Threaded fasteners, such as screws 678, may extend through the wall 679 of the aluminum tubing segments at the end portions and into the segment connectors thereby securing them together. Adhesives and other means may be utilized to maintain the integrity of the segment connectors and tubing segments. Couplers configures as paneling retainer strips 680 secure the paneling to the surface of the tubing segments. The corners 682, 683, 684, 685 of the framework may include corner caps 688 that cover the ends 692 of the paneling retainer strips 680. The retainer strips 680 attach the panel 696 by securing it against the exterior surface 697 of the extrusion segments 662.

Figure 27:
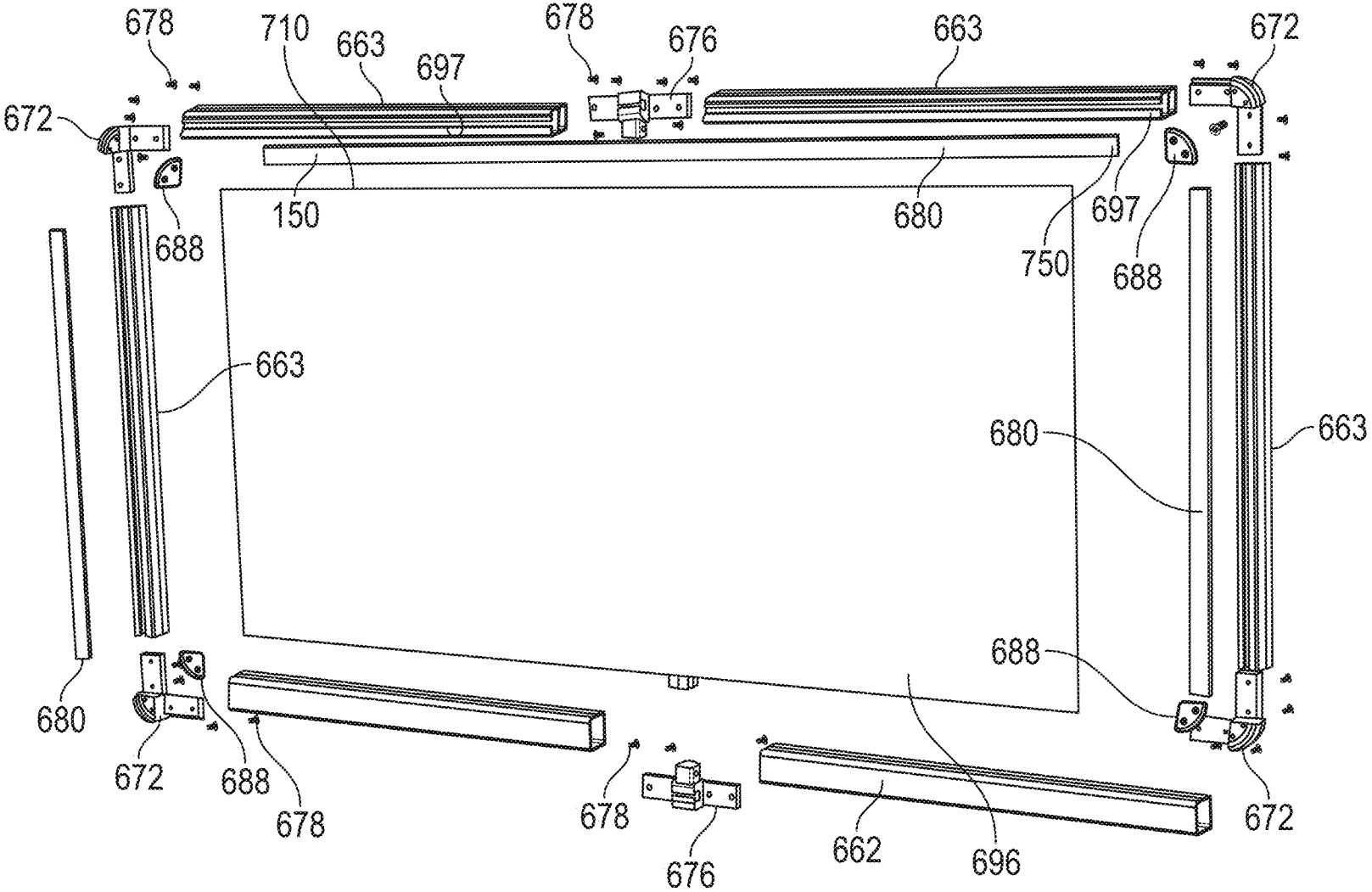
FIG. 27 is an exploded view of the fencing section of FIG. 26.
Figure 28:
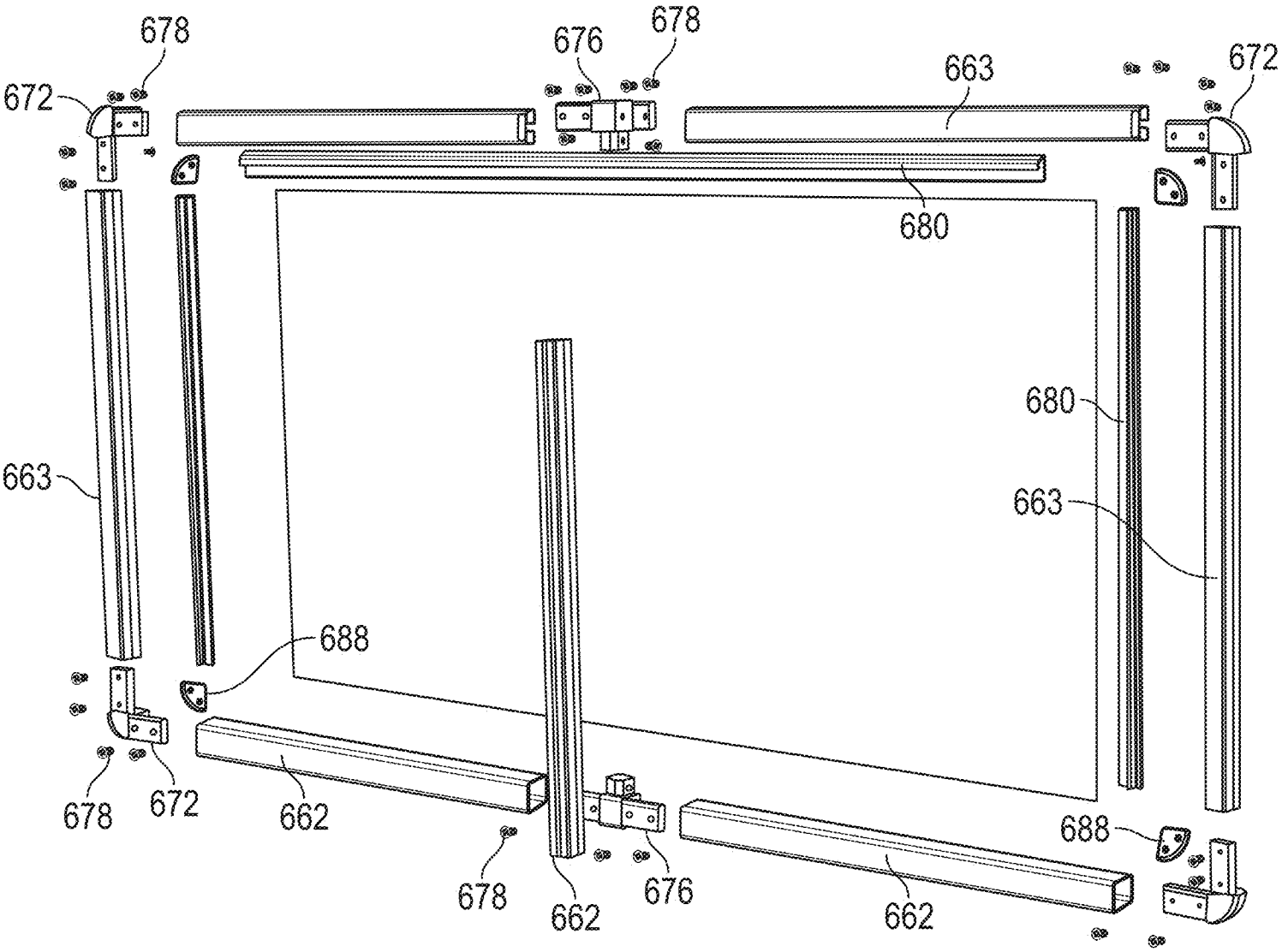
FIG. 28 is an exploded view of the fencing section of FIG. 25.
Figure 29:
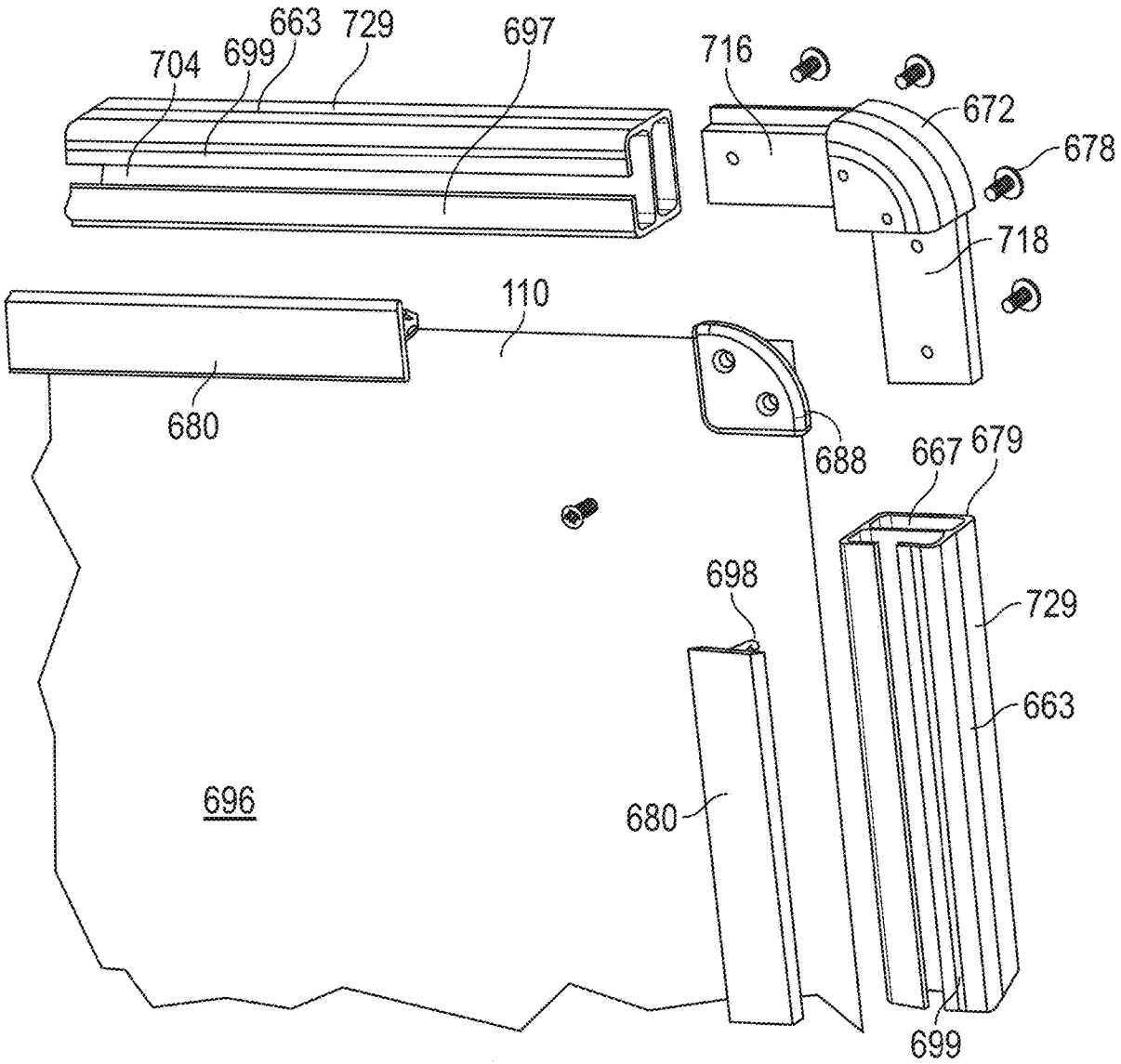
FIG. 29 is a detailed exploded view of a corner of a fencing section in accord with embodiments.
Figure 30:
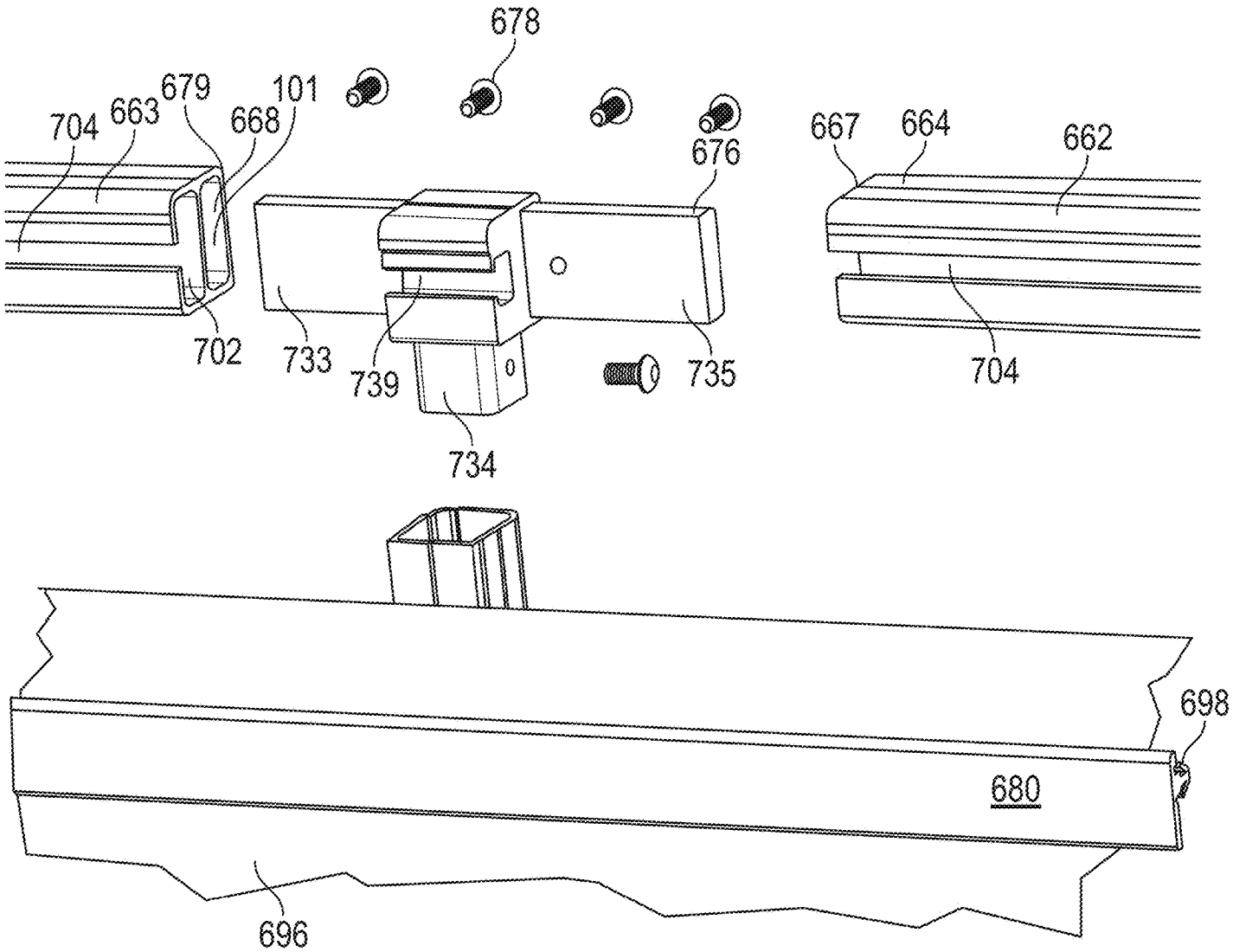
FIG. 30 is a detailed exploded view of an upper central portion of a fencing section in accord with embodiments.
Figure 32:
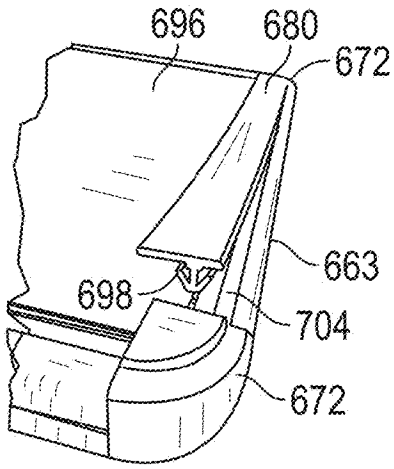
FIG. 32 is a perspective view of an embodiment illustrating a resilient panel retainer strip being installed in a fencing section.

The fencing section 650, as depicted in FIGS. 25-28 have two differently configured tubular extrusions. The uppermost tubular segments 663 and the upright side segments 663 are configured as first tubing configuration having two interiors when viewed from an end, a first closed interior 701, and a second interior 702 with a slot 704 extending to the exterior of the tubing segment. From an end view, the tubing segment 663 has a C-shaped portion and an O-shaped or rectangular portion. The lowermost tubing segments are configured as a second tubing configuration having a single interior 705 and a pair of elongate unitary tab 706 defining an exterior panel edge receiving slot 707. An additional slot 708 may be utilized for attaching the rail to the pontoon deck, for example, by receiving the head of a bolt that extends through the pontoon deck. Features of the first configuration of tubing segments may be combined with features of the tubing segments of the second configuration. Of course, the lowermost tubing segments can also having the first tubing configuration. In embodiments, the fencing section frameworks may be comprised entirely of tubing segments of the first tubing configuration or entirely of tubing segments of the second tubing configuration, or they may combined as depicted in FIGS. 27 and 28.

In embodiments, the retainer strip 80 is best shown in FIGS. 29-34 and 53 and 54 and may be formed of resilient generally rigid polymers material such as polyvinylchloride (PVC) formulations. The retainer strip interfaces the tubular segments at a connection portion 699. An exteriorly exposed elongate flat portion 695 is unitary with a panel insertion portion 698 that may be tapered or arrow shaped, and may have a pair of barbs 700 or flexible wings that deform or deflect inwardly as the insertion portion in inserted in the slot 704 in the C-shaped portion of the tubular segment 663. When fully seated the barbs or wings may return to the undeflected position and effectively secure the retainer strip to the extrusion segment. The retainer strip, when view from the end is generally T-shaped, with the insertion portion defining the lower leg of the T and an upper leg of the T being an edge capture portion 709 that secures an edge portion 710 of the panel 696 to the extrusion segments 663, sandwiching the edge portion between the edge capture portion and the extrusion segment. A shorter upper leg 711 of the T abuts the exterior surface 697 of the extrusion segment and provides leverage to assist maintaining a clamping force by the edge capture portion 709. Other resilient polymer retainers with different configurations are also within the scope of embodiments.

The segment connectors 672, 676 are depicted first as an L-connector illustrated at the four corners 682, 683, 684, and 685 of the framework are depicted in FIGS. 24-29 and 35-40. The L-connectors 672 have a body portion 714 and a pair of insert portions 716, 718 that are sized and shaped to be snuggly fit, such as an interference fit into the open ends 667, 668 of the tubular segments 662. Once installed, screws 678 may be inserted through the wall 679 of the extrusion segments 662 into the insert portions 716, 718 of the connector 672. The main body portion 714 having an outer contour 727 that corresponds to and matches the outer contour 729 of the extrusion segments 662. FIG. 9F illustrates a different shape of the body portion 728 The L-shaped segment connector may be formed such as by injection molding.

The T-shaped segment connector 676 is depicted in FIGS. 27-30 and 47-52. The connector 676 has a main body portion 730 with three insert portions 733, 734, 735 extending from and being unitary with the body portion 730. The two coaxial insert portions 733, 735 are sized for being interferingly received in the open ends 667, 668 of the end portion 664, 666. The main body portion 730 may have a slot 739 to receive the insertion portion 698 of the retainer strip 680. The slot in the segment connector allows a single retainer strip to extend the full width of the fencing framework 660. The main body portion 730 has an outer contour 742 that corresponds with and matches the outer contour 729 of the extrusion portions 662. The T-shaped segment connector may be formed such as by injection molding, machining, or casting.

Figure 34:
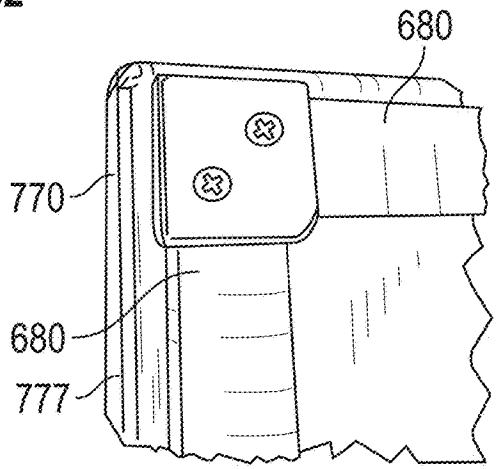
FIG. 34 is a perspective view of a corner of a fencing section with the tubing segments as disclosed herein welded at the corner and with the paneling secured with resilient retainer strips and with a cap covering the ends of the resilient retainer strips.
Figure 33:
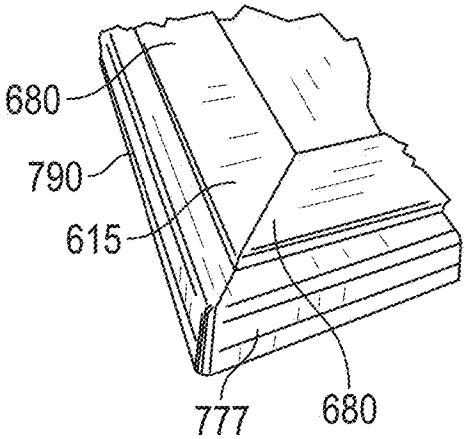
FIG. 33 is a perspective view of a corner of a fencing section with the tubing segments as disclosed herein welded at the corner and with the paneling secured to the tubing segments with resilient retainer strips, the ends of the retainer strips mitered.
Figure 31:
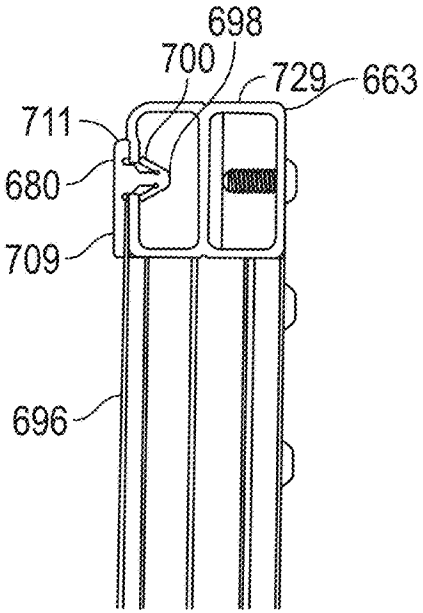
FIG. 31 is an end view of the engagement of a retention strip on a extrusion segment securing an edge portion of a panel.
Figure 37:
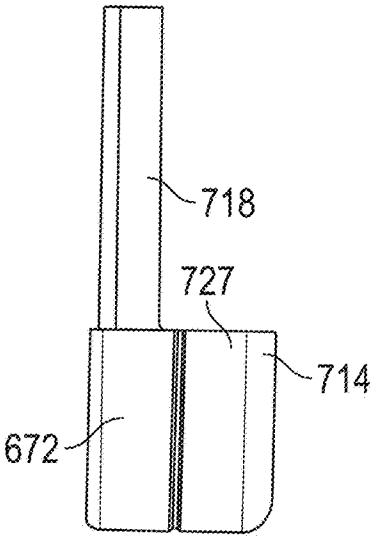
FIG. 37 is a top plan view of the L-connector of FIG. 35.
Figure 40:
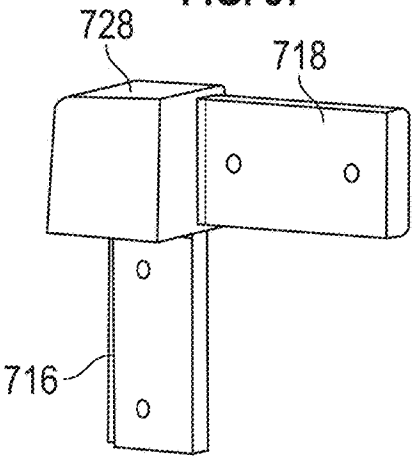
FIG. 40 is another L-connector embodiment.
Figure 36:
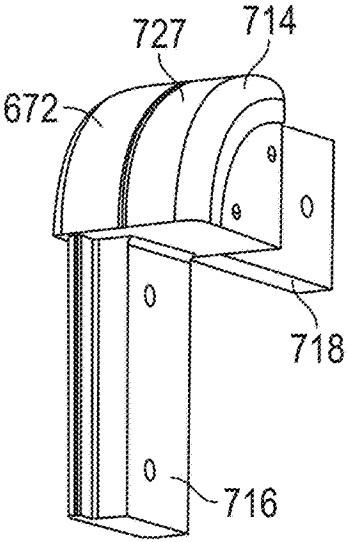
FIG. 36 is another perspective view of the L-connector of FIG. 35 from the opposite side.
Figure 39:
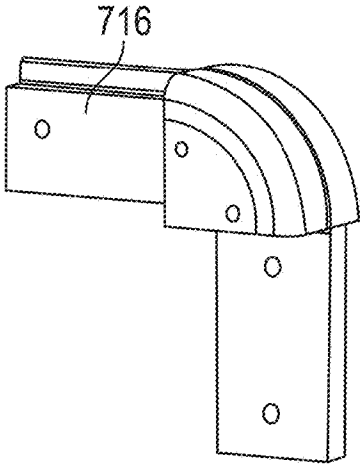
FIG. 39 is another perspective view of an L-connector.
Figure 35:
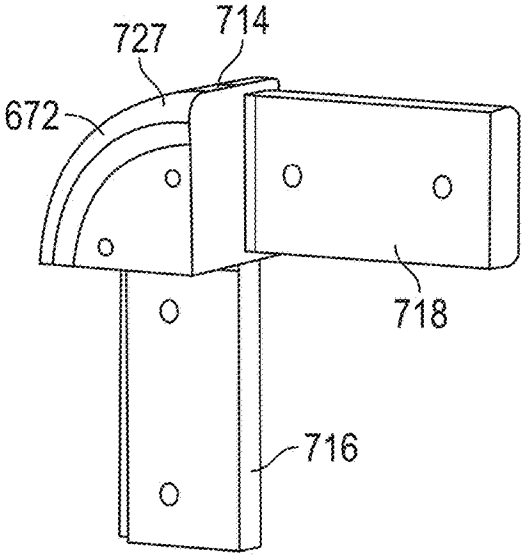
FIG. 35 is a perspective view of a L-connector.
Figure 38:
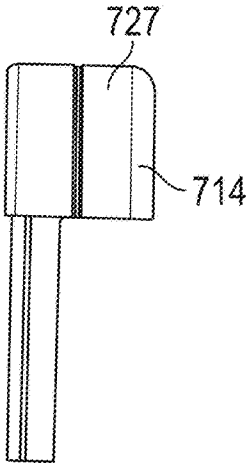
FIG. 38 is a side elevational view of the connector of FIG. 35.
Figure 43:
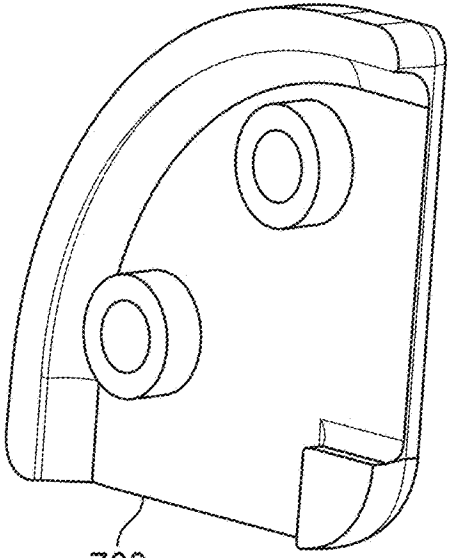
FIG. 43 is another perspective view of the corner cap of FIG. 41.
Figure 46:
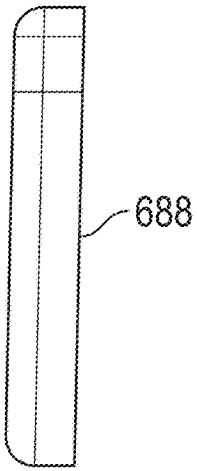
FIG. 46 is a top plan view of the corner cap of FIG. 41.
Figure 42:
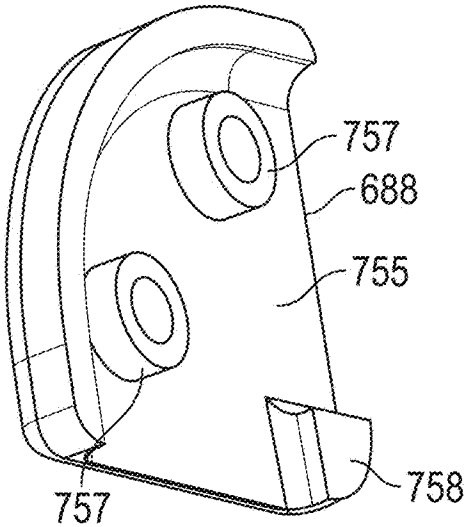
FIG. 42 is a rear perspective view of the corner cap of FIG. 41.
Figure 45:
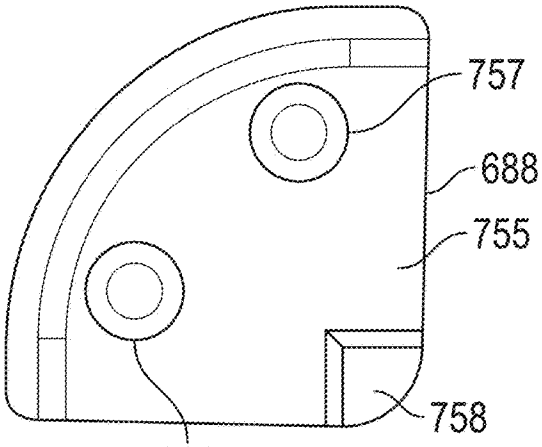
FIG. 45 is a front elevation view of the corner cap of FIG. 41.
Figure 41:
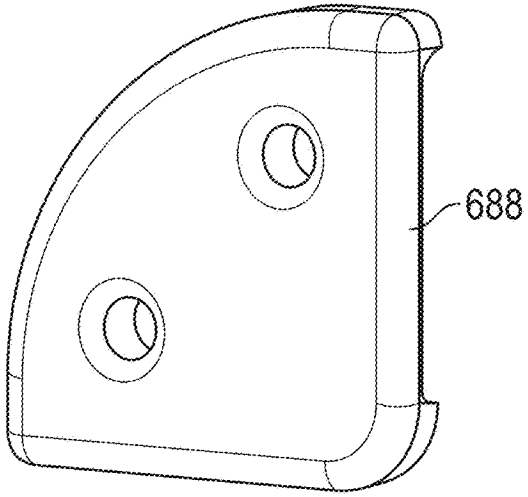
FIG. 41 is front perspective view of a corner cap.
Figure 44:
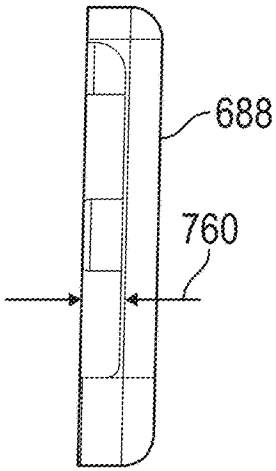
FIG. 44 is a side elevation view of the corner cap of FIG. 41.
Figure 50:
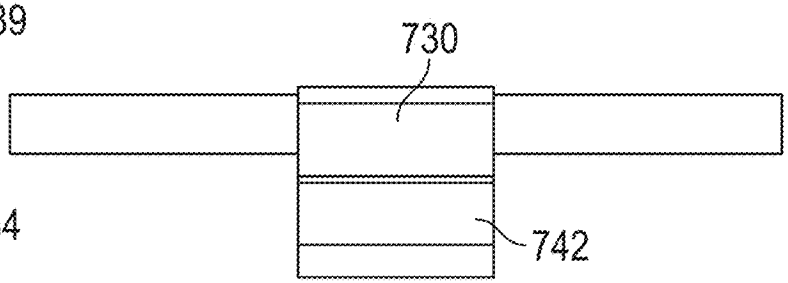
FIG. 50 is a top plan view of the corner cap of FIG. 47.
Figure 51:
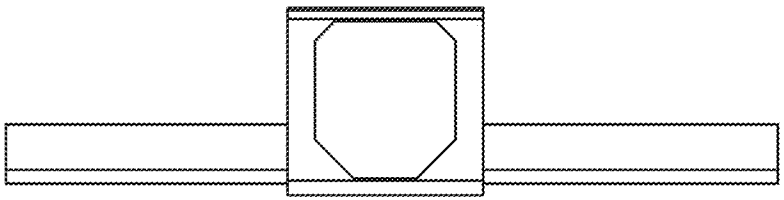
FIG. 51 is a bottom plan view of the corner cap of FIG. 47.
Figure 52:
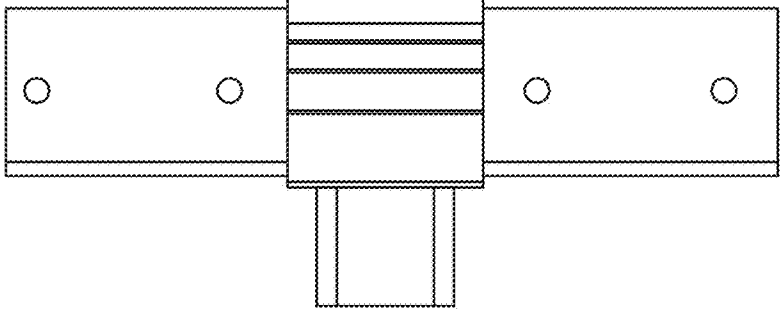
FIG. 52 is a front elevation view of the corner cap of FIG. 47.
Figure 49:
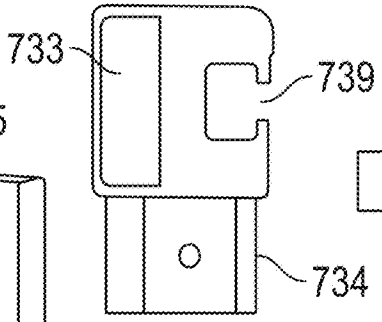
FIG. 49 is a side elevation view of the corner cap of FIG. 47.
Figure 47:
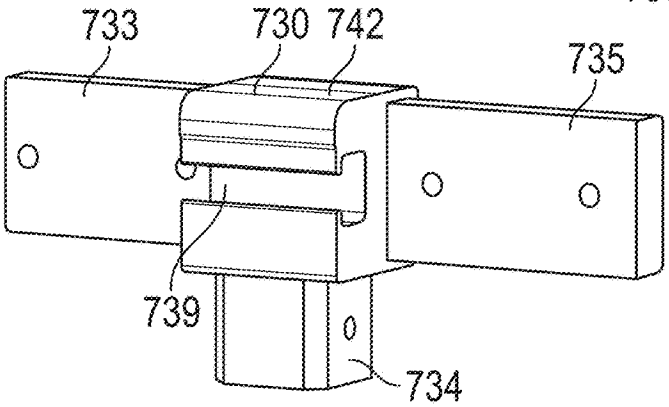
FIG. 47 is front perspective view of a corner cap.
Figure 48:
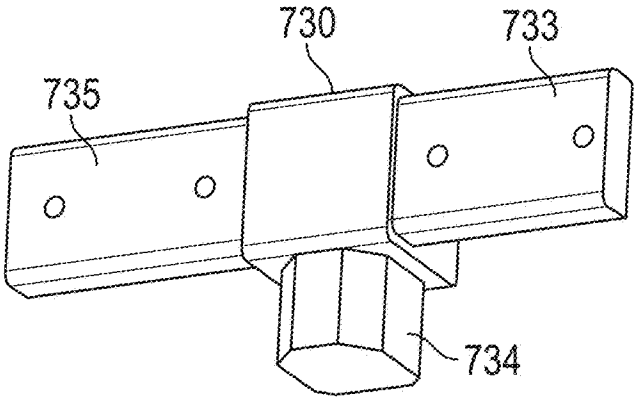
FIG. 48 is a rear perspective view of the corner cap of FIG. 47.
Figure 53:
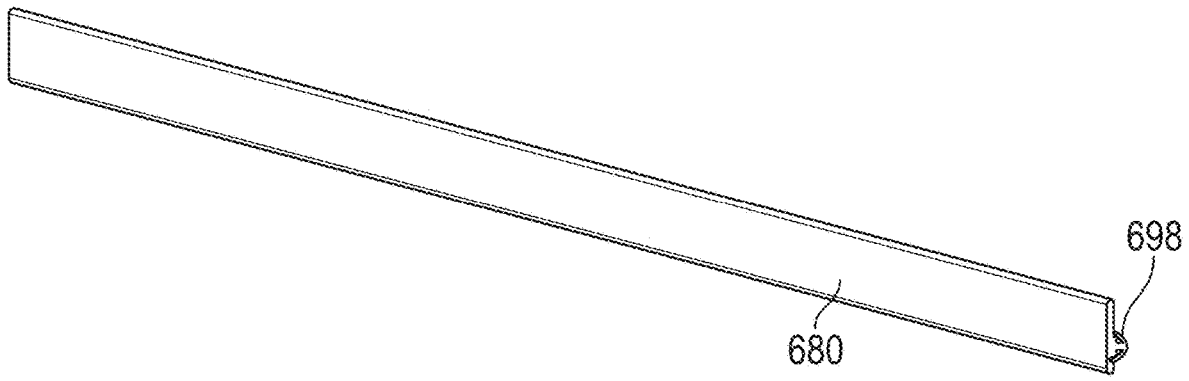
FIG. 53 is a perspective view of a retention strip in accord with embodiments.
Figure 54:
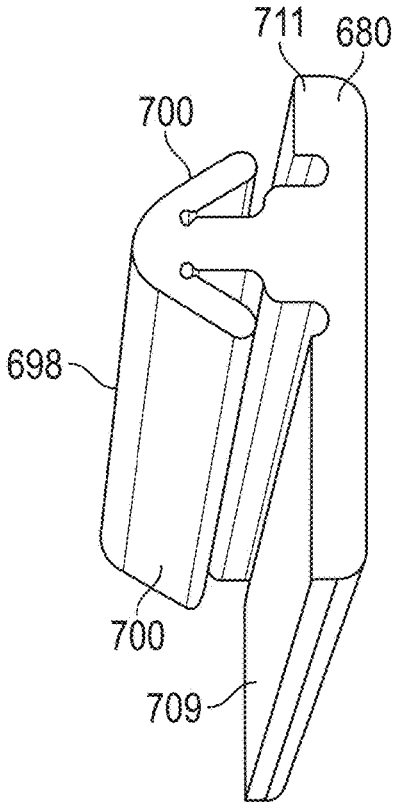
FIG. 54 is a perspective end view of the retention strip of FIG. 53.
Figure 55:
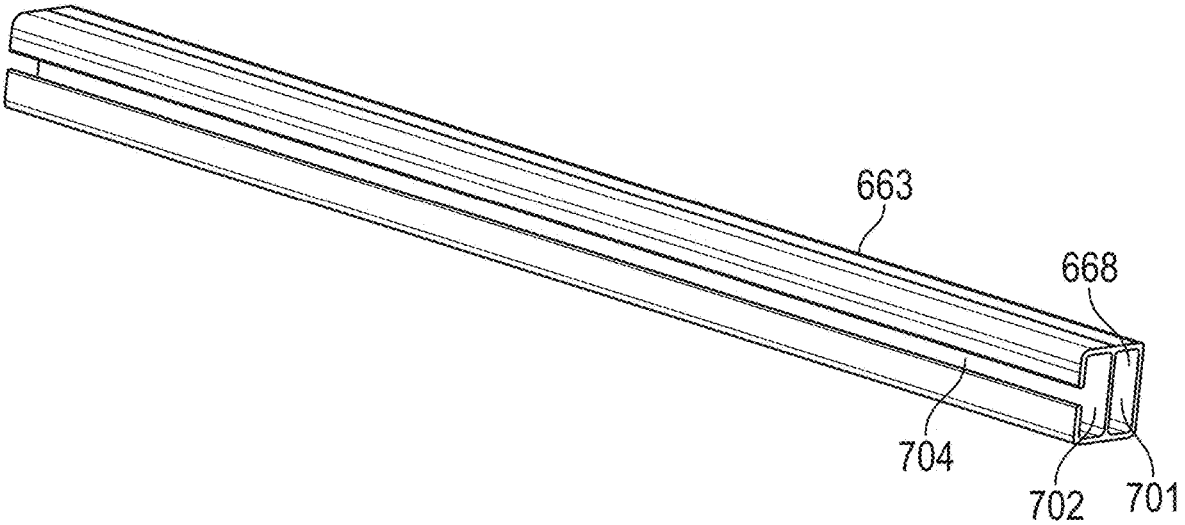
FIG. 55 is an extrusion segment in accord with embodiments.
Figure 56:
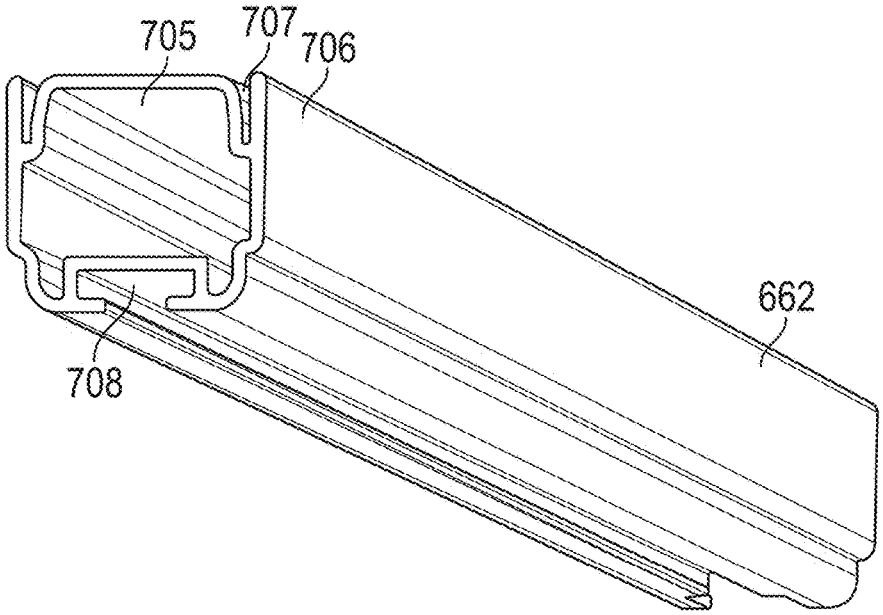
FIG. 56 is another extrusion segment in accord with embodiments.

The corner caps 688, shown best in FIGS. 24, 27, 29, and 41-46, in embodiments, may be formed of a polyvinylchloride formulations, for example, and allow the end portions 750 of the fastener strips to be covered improving the appearance of the fencing section and further holding down and securing the end portions of the fastener strips 680. An interior side 755 may have bosses 757 and spacer 758 providing a gap 760 A pair of screws may attach the end caps to the body portions 714 of the L-shaped connectors 672. FIG. 34 depicts another corner connector 766 that is generally square and may cover, for example, the mitered ends 768, 769 of the panel retainer strips 680 on a welded fencing section framework 770, see FIG. 33. The screws 773 extend through the corner cap, through the retainer strips 680, and into the aluminum frame members 777.

For an initial assembly of a fencing section 650, the aluminum tubular segments 662, 663 may be cut to a desired selected size, the segment connectors 672, 676 may be selected, the tubing segments connected to one another by insertion of the insert portions 716, 718, 733, 735 of the segment connectors into open ends 667, 668 of the tubing segments 662, 663. The connections between the segment connectors and tubing segments may be further secured with threaded fasteners, such as screws 678, extending through the wall of the end portions of the tubing segments into the respective insert portions 716, 718, 733, 735 of the segment connectors. Additionally, adhesives may be utilized to further secure the connections. The tubing segments and connectors are joined to define the fencing section framework 660. Once the framework has been assembled, paneling 696 sized to the framework is positioned in place and secured in place by the retainer strips 680. In embodiments, the retainer strips 680 are press fit onto slots 704 defined in the framework such that edge portions 710 of the paneling 696 is secured between the retainer strips 680 and the surface 697 of the framework. In embodiments double sided tape or adhesives may be utilized for further securement of the paneling. In embodiments, other configurations of retainer strips may be utilized such as retainer strips secured with metal fasteners extending into the framework. Corner caps may be attached to the segment connectors to provide a finished look and to further secure and conceal the ends of the retainer strips.

When a paneling 696 is to be replaced, the retainer strips 680 and corner caps 688 that secure the damaged paneling in place may be removed, a new replacement paneling positioned on the framework and new or existing retainer strips 680 and corner caps 688 are reattached to secure the replacement paneling in place. In this manner, the paneling replacement may be made without requiring replacement of the fencing framework or removal from the pontoon of the fencing framework.

Similarly, modular framework components, if damaged, or if otherwise desired to be changed out, may be replaced by partial disassembly of the needed connections to remove the particular component or components to be replaced. That is, removal of retainer strips on to be replaced components or adjacent to the to be replaced components, removal of screws 78 from the connections, removal of the insert portions of the segment connectors from the ends of the connected tubing segments thereby disconnecting the respective segment connectors. Then the segment connectors and/or segments may be replaced and the framework reassembled.

Referring to FIG. 1, in embodiments, the weldless modular components described herein may be combined with framework portions 670, 671 welded together in particular configurations. Such portions may be more intricate, for example, than framework formed from L-connectors 672 and T-connectors 676. The welded framework portions may have open segment end portions to facilitate connection to the modular framework. In embodiments, the welded framework portions may have slots, or other features for receiving retainer strips as illustrated and/or described herein.

Referring to FIG. 57, steps 801-837 associated with a method 800 for the assembly and repair of pontoon fencing are identified. The steps 801-837 may be combined in different orders and combinations and may be combined selectively with any of the steps 801-837 disclosed herein or in the patents and publications incorporated by reference herein.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed. U.S. Pat. Nos. 11,312,450; 11,192,610; and 7,950,340 are incorporated by reference herein. The above references in all sections of this application are herein incorporated by references in their entirety for all purposes.

While the aforementioned particular embodiments of the present invention have been shown and described, it will be obvious to those skilled in the art that, based upon the teachings herein, that changes and modifications may be made without departing from this invention and its broader aspects. Therefore, the appended claims are to encompass within their scope all such changes and modifications as are within the true spirit and scope of this invention. It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to inventions containing only one such element, even when the same claim includes the introductory phrases "one or more" or "at least one" and indefinite articles such as "a" or "an"; the same holds true for the use in the claims of definite articles.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A pontoon boat having a bow, a stern, a port side, a starboard side, the pontoon boat comprising:

a deck, the deck having a deck periphery;

a starboard pontoon and a port pontoon secured to a bottom side of the deck;

pontoon boat furniture mounted on a top of the deck; and a fencing mounted to the deck, the fencing defining a passenger area on the deck which includes the pontoon boat furniture, the fencing extending along the deck periphery at the starboard side and the port side of the deck, the fencing spaced from or positioned at the deck periphery at the bow, and the fencing spaced from the deck periphery at the stern;

wherein the fencing comprises a plurality of fencing sections, each fencing section comprising a fencing framework and paneling secured to the fencing framework;

wherein the fencing framework of each fencing section comprises a plurality of aluminum tubular extrusion segments with opposing open ends, a plurality of segment connectors interconnecting the plurality of aluminum tubular extrusion segments, each segment connector having a main body portion and a plurality of insert portions extending from and unitary with the main body portion, the plurality of insert portions each sized for and received in the opposing open ends of each aluminum tubular extrusion segment of the plurality of aluminum tubular extrusion segments connecting thereto; the main body portion of each segment connector outwardly exposed and having an outer peripheral contour that is substantially flush with outer peripheral contours of each aluminum tubular extrusion segment connected thereto, the plurality of aluminum tubular extrusion segments including a plurality of panel-holding tubular extrusion segments, the fencing framework of each fencing section further comprising a plurality of edge panel retainer strips, each edge panel retainer strip attached to a respective panel-holding tubular extrusion segment of the plurality of panel-holding tubular extrusion segments that secures an edge portion of the paneling to the respective panel-holding tubular extrusion segment.

2. The pontoon boat of claim 1, wherein each edge panel retainer strip of the plurality of edge panel retainer strips is formed of a resilient polymer and has, when viewed from an end, a C-shape that engages three sides of a respective aluminum tubular extrusion segment of the plurality of aluminum tubular extrusion segments to which a respective edge panel retainer strip of the plurality of edge panel retainer strips is engaged.

3. The pontoon boat of claim 1, wherein each of the plurality of edge panel retainer strips of each fencing framework is formed of a resilient polymer and has a T-shape with a lower leg of the T-shape comprising an insertion portion that is received in a slot in a respective aluminum tubular extrusion segment of the plurality of aluminum tubular extrusion segments to which a respective edge panel retainer strip of the plurality of edge panel retainer strips is engaged.

4. The pontoon boat of claim 1, wherein each of the plurality of edge panel retainer strips of each fencing framework has a unitary insertion portion that is received in a slot in a respective aluminum tubular extrusion segment of the plurality of aluminum tubular extrusion segments to which a respective edge panel retainer strip of the plurality of edge panel retainer strips is engaged.

5. The pontoon boat of claim 1, wherein the plurality of segment connectors of each fencing framework includes an L-segment connector, the L-segment connector having two non-coaxial insert portions.

6. The pontoon boat of claim 1, wherein the plurality of aluminum tubular extrusion segments of each fencing framework comprise a lowermost segment defining a lower margin of each fencing framework, and an upper most segment defining an uppermost margin of each fencing framework.

7. The pontoon boat of claim 1, wherein each segment connector of the plurality of segment connectors comprises polyvinylchloride.

8. The pontoon boat of claim 1, wherein each insert portion of the plurality of insert portions is secured to a respective aluminum tubular extrusion segment of the plurality of aluminum tubular extrusion segments to which a respective insert portion of the plurality of insert portions is connected by at least one screw or rivet extending through a wall of the respective aluminum tubular extrusion segment into the respective insert portion.

9. The pontoon boat of claim 1, wherein the fencing framework of each fencing section does not have any welded joints.

10. A fencing section for pontoon boat decks, the fencing section comprising:

an aluminum framework comprising a plurality of aluminum rails with slots therein, a plurality of resilient polymer panel edge portion retention strips; and a paneling sized to the aluminum framework, the paneling having an edge portion extending therearound;

wherein two or more aluminum rails of the plurality of aluminum rails have a slot extending lengthwise thereon receiving a resilient polymer panel edge portion retention strip of the plurality of resilient polymer panel edge portion retention strips engaged with the edge portion of the paneling thereby securing the paneling on the aluminum framework.

11. The fencing section of claim 10, wherein each resilient polymer panel edge portion retention strip of the plurality of resilient polymer panel edge portion retention strips has a C-shape for extending around three sides of each respective aluminum rail with which each respective retention strip is received.

12. The fencing section of claim 10, wherein each aluminum rail of the plurality of aluminum rails is connected to other aluminum rails of the plurality of aluminum rails by a plurality of welded connections.

13. The fencing section of claim 10, wherein each aluminum rail of the plurality of aluminum rails is configured as an aluminum tubular extrusion segment and wherein the plurality of aluminum rails are connected by a plurality of segment connectors, each segment connector having a body portion and a plurality of insert portions received in ends of the plurality of aluminum rails.

14. The fencing section of claim 13, wherein the plurality of segment connectors includes inline connectors where two insert portions are in coaxial alignment, and a plurality of L connectors where two insert portions are not coaxially aligned.

15. The fencing section of claim 10, wherein each resilient polymer panel edge portion retention strip of the plurality of resilient polymer panel edge portion retention strips has an exposed flat portion that seats on an exterior surface of one of the plurality of aluminum rails with the edge portion of the paneling sandwiched between the exposed flat portion of each resilient polymer panel edge portion retention strip and each respective aluminum rail of the plurality of aluminum rails to which each resilient polymer panel edge portion retention strip is attached.

* * * * *